US009410274B2

(12) United States Patent
Ota et al.

(10) Patent No.: US 9,410,274 B2
(45) Date of Patent: Aug. 9, 2016

(54) SEWING MACHINE

(71) Applicant: BROTHER KOGYO KABUSHIKI KAISHA, Nagoya, Aichi (JP)

(72) Inventors: Manami Ota, Nagoya (JP); Akie Shimizu, Nagoya (JP); Yoshio Nishimura, Nagoya (JP); Yoshinori Nakamura, Toyohashi (JP); Yutaka Nomura, Anjo (JP); Daisuke Abe, Nagoya (JP); Yuki Ihira, Kakamigahara (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/619,480

(22) Filed: Feb. 11, 2015

(65) Prior Publication Data

US 2015/0233032 A1 Aug. 20, 2015

(30) Foreign Application Priority Data

Feb. 19, 2014 (JP) ..... 2014-029595

(51) Int. Cl.
*D05B 19/12* (2006.01)
*D05B 81/00* (2006.01)

(52) U.S. Cl.
CPC ..... *D05B 19/12* (2013.01); *D05B 81/00* (2013.01); *D05D 2207/04* (2013.01)

(58) Field of Classification Search
CPC ..... D05D 2207/04; D05D 2305/08; D05B 21/00; D05B 39/00; D05C 11/16
USPC ..... 112/470.05, 470.06, 470.09, 84, 85, 89, 112/98, 80.4
See application file for complete search history.

(56) References Cited

U.S. PATENT DOCUMENTS

| | | | | |
|---|---|---|---|---|
| 4,455,956 | A * | 6/1984 | Yamamoto | D05B 21/00 112/274 |
| 5,555,834 | A * | 9/1996 | Bonner | D05B 3/10 112/129 |
| 7,620,472 | B2 * | 11/2009 | Hamajima | D05B 19/12 112/102 |
| 7,966,955 | B2 * | 6/2011 | Niizeki | D05C 7/04 112/89 |
| 8,272,341 | B2 * | 9/2012 | Konig | D05B 37/04 112/128 |
| 2009/0205549 | A1 | 8/2009 | Hirose et al. | |

FOREIGN PATENT DOCUMENTS

| | | | |
|---|---|---|---|
| JP | H06-81263 | A | 3/1994 |
| JP | 2002-292175 | A | 10/2002 |
| JP | 2009-189626 | A | 8/2009 |

* cited by examiner

*Primary Examiner* — Tejash Patel
(74) *Attorney, Agent, or Firm* — Oliff PLC

(57) ABSTRACT

A sewing machine includes a detection unit configured to detect a moving direction of an object when the object placed on a sewing machine bed is moved in any direction, a cutting needle having a distal end formed with a blade edge and configured to form a cut in the object, an up-down drive mechanism configured to reciprocate the needle in an up-down direction, a rotational drive mechanism configured to rotate the needle about a rotation axis line of the needle, and a control device configured to control the up-down drive mechanism and the rotational drive mechanism based on a result of detection by the detection unit so that an orientation of the blade edge is changed according to the moving direction of the object and the needle is reciprocated to form the cut in the object with the blade edge being in the changed orientation.

8 Claims, 17 Drawing Sheets

SEWING MACHINE

CROSS-REFERENCE TO RELATED APPLICATIONS

This application is based upon and claims the benefit of priority from the prior Japanese Patent Application No. 2014-029595 filed on Feb. 19, 2014, the entire contents of which are incorporated herein by reference.

BACKGROUND

1. Technical Field

The present disclosure relates to a sewing machine.

2. Related Art

A sewing machine has conventionally been known which sews an embroidery pattern based on embroidery data. This type of sewing machine includes a storage device storing embroidery data of a plurality of embroidery patterns. A user selects a desirable one of the embroidery patterns. The sewing machine reads the embroidery data of the selected embroidery pattern and instructs a transfer mechanism to transfer an embroidery pattern holding a workpiece cloth while a needle bar with a needle attached thereto is being moved up and down by an up-down moving mechanism. The embroidery pattern is sewn on the workpiece cloth by the operation.

The above-described sewing machine includes a type added with a boring function which makes cuts in the workpiece cloth. More specifically, a boring knife (a cutting needle) is attached to the needle bar, instead of the needle. Boring data is stored in a storage device. The boring data is indicative of cut positions in the workpiece cloth. The sewing machine reads the boring data and transfers the embroidery frame while the needle bar with the cutting needle being attached thereto is being moved up and down. Successive cuts are formed on the workpiece cloth by this operation, so that the workpiece cloth is cut into a predetermined configuration.

SUMMARY

The sewing machine constructed as described above can form a cut pattern with a predetermined configuration on the workpiece cloth based on the boring data. However, the user sometimes wishes to cut the workpiece cloth into an arbitrary configuration, instead of a cut pattern of a predetermined configuration. In this case, for example, boring data to cut the arbitrary configuration needs to be generated using a dedicated data generator. The generation of boring data takes a lot of trouble and is cumbersome.

Therefore, an object of the disclosure is to provide a sewing machine which can easily form a cut pattern desired by the user on the workpiece cloth.

The disclosure provides a sewing machine including a detection unit configured to detect a moving direction of an object to be processed when the object placed on a sewing machine bed is moved in any direction, a cutting needle having a distal end formed with a blade edge and configured to form a cut in the object, an up-down drive mechanism configured to reciprocate the cutting needle in an up-down direction, a rotational drive mechanism configured to rotate the cutting needle about a rotation axis line of the cutting needle, and a control device configured to control the up-down drive mechanism and the rotational drive mechanism based on a result of detection by the detection unit so that an orientation of the blade edge is changed according to the moving direction of the object and the cutting needle is reciprocated to form the cut in the object with the blade edge being in the changed orientation.

The disclosure also provides a sewing machine including a detection unit configured to detect a moving direction and a movement amount of an object to be processed when the object placed on a sewing machine bed is moved in any direction, a cutting needle having a distal end formed with a blade edge and configured to form a cut in the object, an up-down drive mechanism configured to reciprocate the cutting needle in an up-down direction, a rotational drive mechanism configured to rotate the cutting needle about a rotation axis line of the cutting needle, a first pitch setting unit configured to set a pitch length to a first pitch length, said pitch length being an interval between cuts formed in the object by an up-down movement of the cutting needle, and a control device configured to control the up-down drive mechanism and the rotational drive mechanism based on a result of detection by the detection unit so that an orientation of the blade edge is changed according to the moving direction of the object and the cutting needle is reciprocated to form the cut in the object at the first pitch length with the blade edge being in the changed orientation.

DETAILED DESCRIPTION

A first embodiment will be described with reference to FIGS. 1 to 14C. The first embodiment is directed to a household sewing machine which is capable of sewing an embroidery pattern and which will hereinafter be referred to as "sewing machine M."

Figure 1:
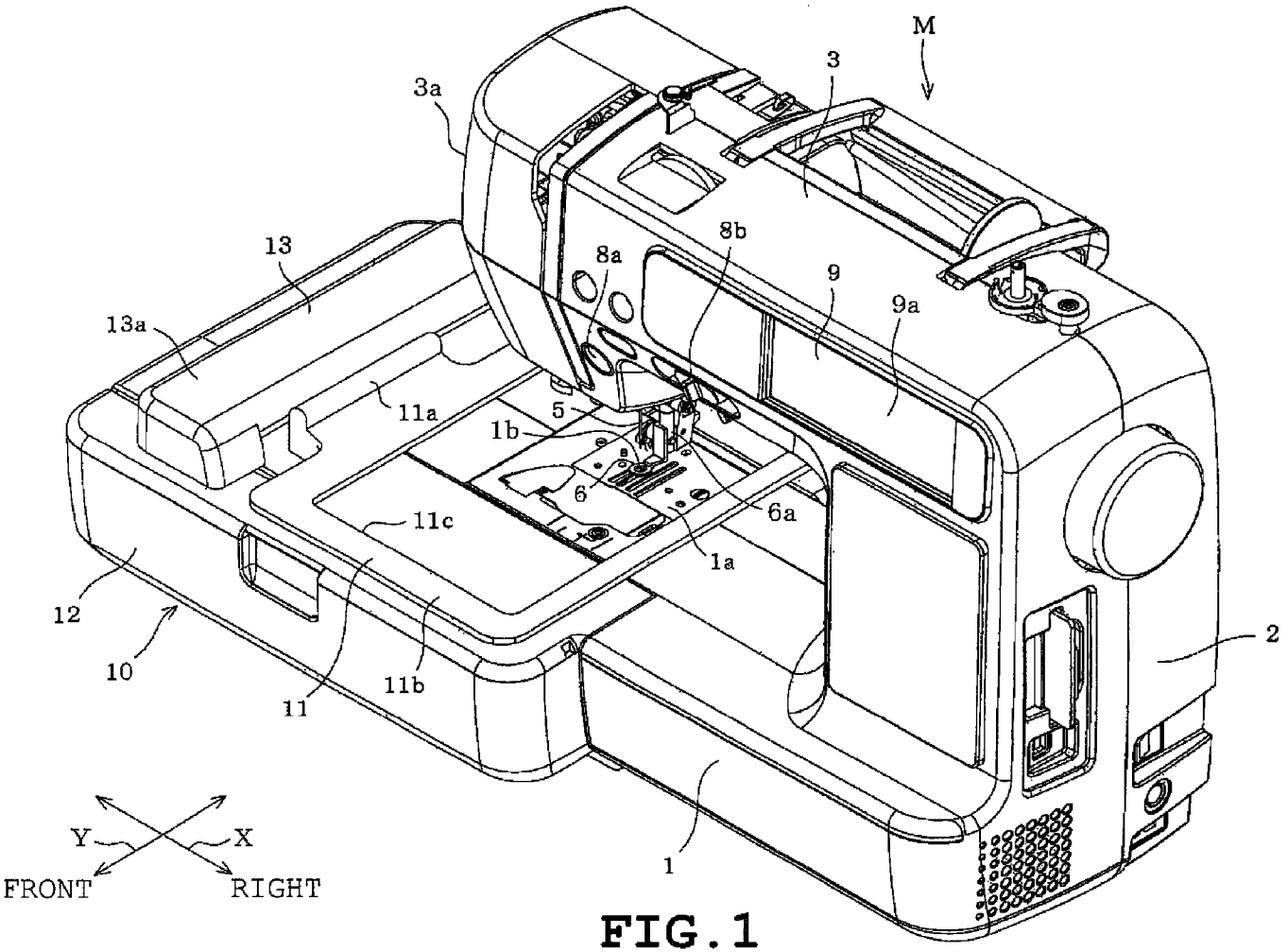
FIG. 1 is a perspective view of an entire sewing machine according to a first embodiment together with an attachment.

Referring to FIG. 1, the sewing machine M includes a bed 1 extending in a right-left direction, a pillar standing upward from a right end of the bed 1 and an arm 3 extending leftward from an upper part of the pillar 2, all of which are integrally formed with the sewing machine M. A main shaft (not shown) and a sewing machine motor 4 (see FIG. 10) are provided in the arm 3. The main shaft extends in the right-left direction. The sewing machine motor 4 is provided in the pillar 2 to rotate the sewing machine shaft.

In the following description, the side where a user is located relative to the sewing machine M will be referred to as "front" of the sewing machine, that is, the front of the sewing machine is the side where switches and a display unit both of which will be described later are located in the sewing machine M. The side located opposite the front will be referred to as "rear." The side where the pillar 2 is located in the sewing machine M will be referred to as "right" and the distal end side of the arm 3 will be referred to as "left." The front-back direction is a Y direction and the direction perpendicular to the Y direction is an X direction.

Figure 2:
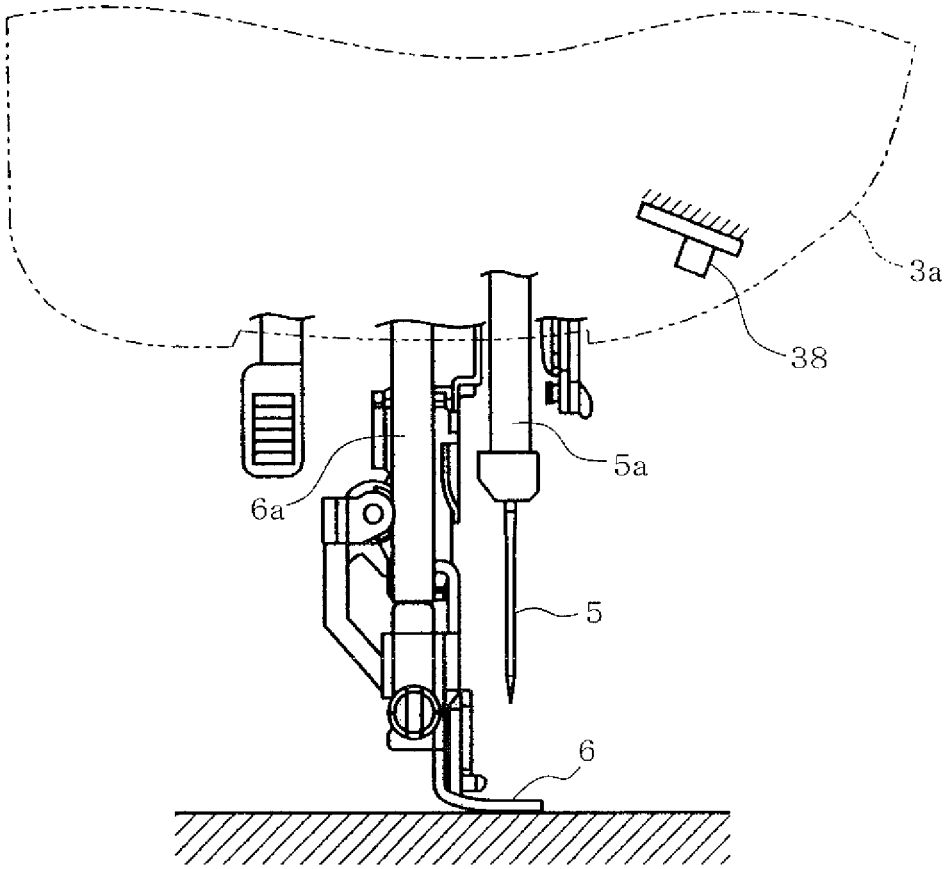
FIG. 2 is a left side view of a sewing machine head, showing an arrangement of a camera.

A sewing machine head 3*a* is provided at the distal end side of the arm 3 as shown in FIG. 2. A needle bar 5*a* and a presser bar 6*a* are provided on the sewing machine head 3*a*. The needle bar 5*a* has a lower end to which a sewing needle 5 is attached. The presser bar 6*a* has a lower end on which a presser foot 6 is mounted. In the arm 3 are provided a needle bar drive mechanism, a needle bar swinging mechanism, a take-up lever drive mechanism, a presser bar drive mechanism and the like, none of which are shown. The needle bar drive mechanism moves the needle bar 5*a* up and down by rotation of the main shaft. The needle bar swinging mechanism swings the needle bar 5*a* in a right-left direction. The take-up lever drive mechanism moves a take-up lever up and down in synchronization with the up-and-down motion of the needle bar 5*a*. The presser bar drive mechanism moves the presser bar 6*a* up and down.

The bed 1 has a top on which a needle plate 1*a* is mounted. In the bed 1 are provided a cloth feed mechanism, a rotating shuttle, a thread cutting mechanism and the like, all of which are located below the needle plate 1*a* and none of which are shown. The cloth feed mechanism moves a feed dog in the up-down direction and the front-back direction. The rotating shuttle houses a bobbin and forms stitches in cooperation with the sewing needle 5. The thread cutting mechanism cuts the needle thread and the bobbin thread.

A switching lever (not shown) is provided on a rear surface of the bed 1 to switch the feed dog between an operative state and a non-operative state. When in the operative state, the feed dog appears above and disappears below the needle plate 1*a* thereby to feed a workpiece cloth. When in the non-operative state, the feed dog remains below the needle plate 1*a*. The switching lever is configured to switch the feed dog from the operative state to the non-operative state in conjunction with the attaching of an attachment 10 to the sewing machine M although the switching will not be described in detail. The attachment 10 will be described later.

Various switches including a start/stop switch 8*a*, and a speed adjusting knob 8*b* are mounted on a front of the arm 3. The start/stop switch 8*a* instructs start and stop of a sewing operation of the sewing machine M. The speed adjusting knob 8*b* is operated to set a sewing speed, that is, a rotating speed of the main shaft. A display 9 is mounted on a front of the pillar 2. The display 9 displays various sewing patterns including practical patterns and embroidery patterns, various names of functions to be executed in a sewing work, various messages and the like. A touch panel 9*a* (see FIG. 10) is mounted on a front of the display 9. The touch panel 9*a* has a plurality of touch keys comprising transparent electrodes. When the user touches one or more touch keys, a desirable sewing pattern can be selected, functions can be instructed and parameters can be set.

Figure 3A:
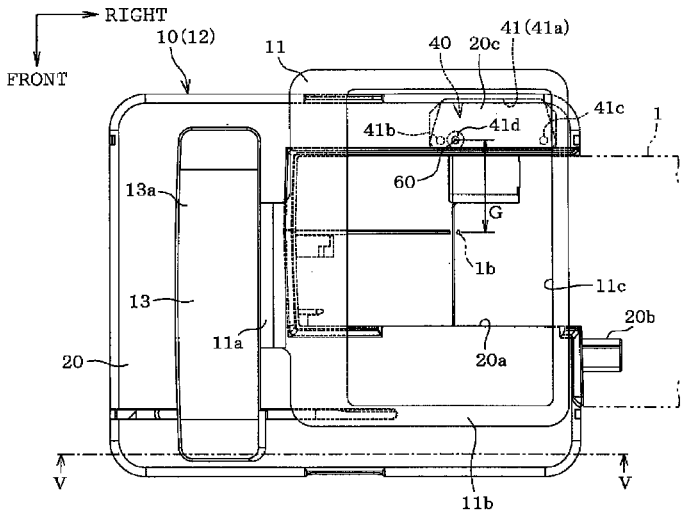
FIGS. 3A and 3B are a plan view and a bottom view of the attachment together with a moving table respectively.

The attachment 10 shown in FIG. 3A is detachably attached to a left part of the bed 1. The bed 1 includes a part located on the left of a substantially central part thereof although the part is not shown in detail. The part of the bed 1 is formed into a generally quadrangular prism extending leftward. This part will be referred to as "free arm bed." When the attachment 10 has been attached to the bed 1, a fitting part 20*a* (see FIG. 3A) of the attachment 10 is fitted with the free arm bed, as will be described in detail later.

The attachment 10 has a function of an embroidering device which transfers an embroidery frame (not shown) holding the workpiece cloth in the X direction and the Y direction over upper sides of the bed 1 and the attachment 10. The attachment 10 also has a function of a support device which supports a moving table 11 (see FIG. 1) so that the moving table 11 is movable in the X direction and the Y direction, when the moving table 11 is attached, instead of an embroidery frame. The moving table 11 will be described later. The attachment 10 further has a cutting function of forming a cut in the workpiece cloth.

The attachment 10 will be described with reference to FIGS. 3A to 5. The attachment 10 includes a body 12 and a moving part 13. An upper surface of the body 12 is on a level with an upper surface of the bed 1 when the attachment 10 has been attached to the bed 1. The moving part 13 is mounted on the upper surface of the body 12 to be movable in the X direction.

The body 12 of the attachment 10 includes a body cover 20 formed into a generally rectangular box shape as a whole as shown in FIG. 3A. The fitting part 20*a* having an upper opening is provided on a right part of the body cover 20 so as to be located in the middle of the body cover 20 in the front-back direction. The fitting part 20*a* is fitted with the free arm bed while the body 12 is being slid rightward relative to the bed 1, so that the attachment 10 is attached to the bed 1. The body cover 20 has aright end provided with a connector 20*b*. When the attachment 10 is attached to the sewing machine M, the connector 20*b* is connected to a connector at the sewing machine M side, with the result that the attachment 10 is electrically connected to a control device 39 (see FIG. 10) of the sewing machine M.

Figure 4:
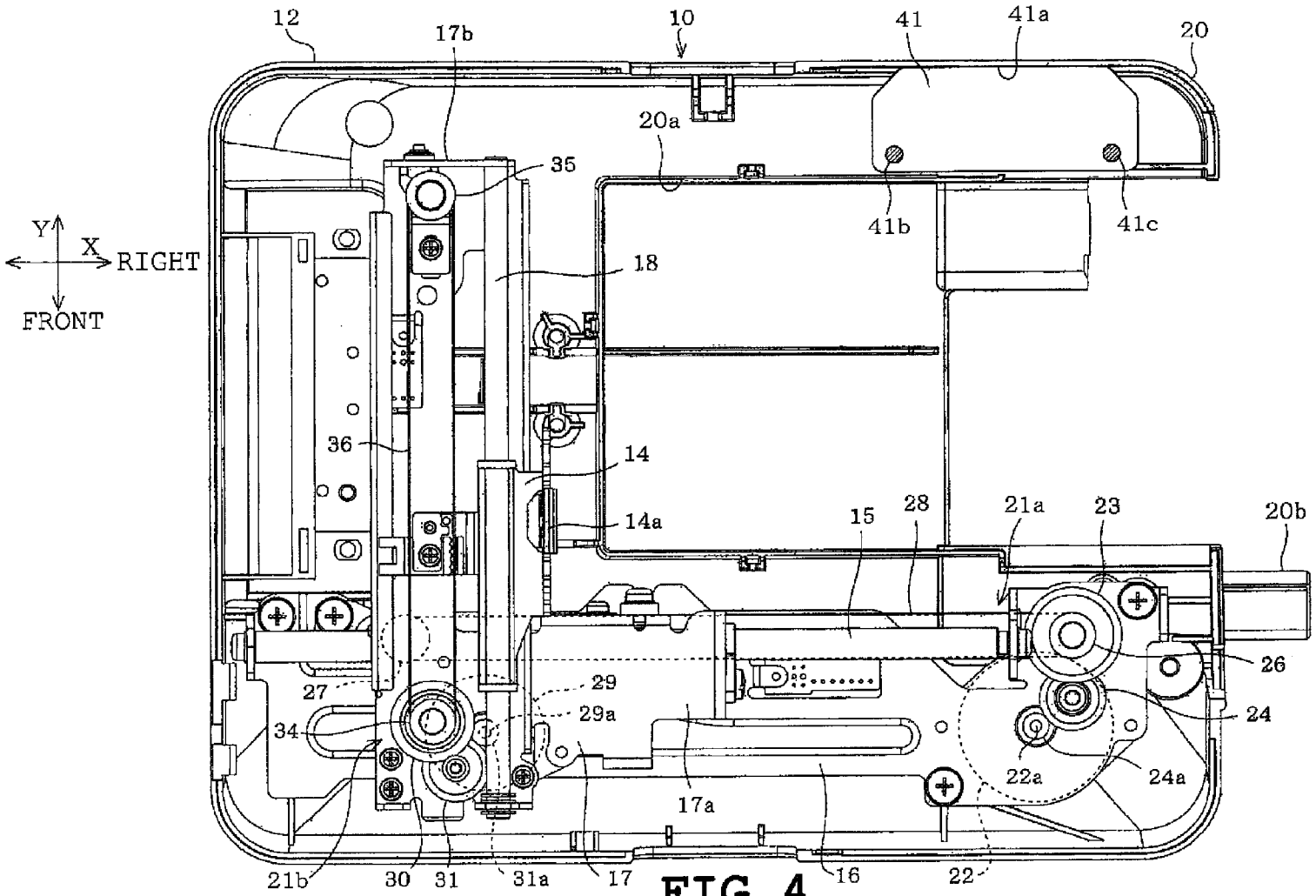
FIG. 4 is a cross-sectional view of the attachment, showing an inner structure thereof.
Figure 5:
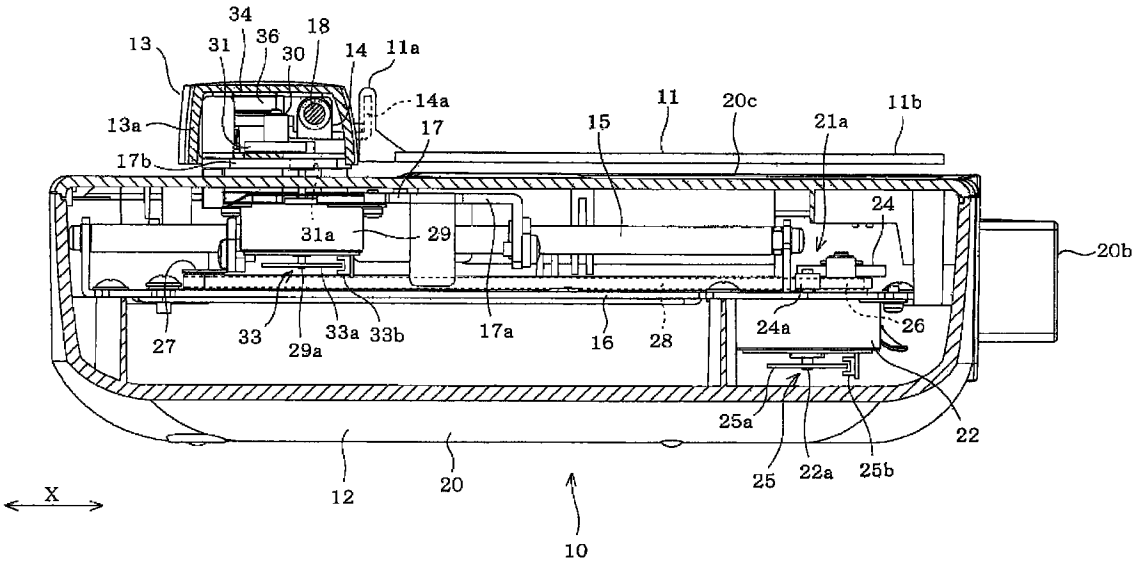
FIG. 5 is a longitudinal section of the attachment.

The moving part 13 is provided with a carriage 14 (see FIGS. 4 and 5). The carriage 14 is movable in the Y direction. An embroidery frame or the moving table 11 is attached to the carriage 14. The moving table 11 attached to the carriage 14 is supported so as to be movable in the X direction and the Y direction on the upper surfaces of the bed 1 and the body 12.

A fixing frame 16 extending in the right-left direction is mounted inside the body 12 as shown in FIGS. 4 and 5. An X-direction guide shaft 15 extending in the right-left direction is fixed to the fixing frame 16. A moving frame 17 includes a first frame 17*a* and a second frame 17*b*. The first frame 17*a* is supported on the X-direction guide shaft 15 so as to be movable. The second frame 17*b* is connected to an upper part of the first frame 17*a*. As a result, the moving frame 17 is supported on the X-direction guide shaft 15 so as to be movable in the X direction. The first frame 17*a* is housed in the body cover 20. The second frame 17*b* is covered by a moving part cover 13*a*.

A Y-direction guide shaft 18 extending in the front-back direction is fixed to the second frame 17*b*. The carriage 14 is supported by the Y-direction guide shaft 18 to be movable in the Y direction. The carriage 14 has an applied part 4*a* formed therein. The moving table 11 has an attaching part 11*a* which is detachably attached to the applied part 14*a* as will be described later. The above-described attachment 10 functions as a support device which movably support the moving table 11.

The moving table 11 is formed into the shape of a rectangular frame as a whole as shown in FIG. 3A. The moving table 11 has a thin frame-shaped body 11*b* and an attaching part 11*a* formed on a left edge of an outer periphery of the body 11*b*. The body 11*b* and the attaching part 11*a* are formed integrally with the moving table 11. The body 11*b* has a rectangular opening 11*c* formed thereinside. The opening 11*c* has an inner region where a workpiece cloth can be cut when a free motion cutting is carried out. The attaching part 11*a* is attached to the applied part 14*a* of the carriage 14. The workpiece cloth is placed on four sides of the body 11*b* so as to overlay the body 11*b*, so that the workpiece cloth can be moved in the X direction and the Y direction together with the moving table 11.

The attachment 10 is provided with a first displacement detection mechanism 21*a* and a second displacement detection mechanism 21*b*. The first displacement detection mechanism 21*a* detects a displacement of the moving table 11 in the X direction. The second displacement detection mechanism 21*b* detects a displacement of the moving table 11 in the Y direction. The first displacement detection mechanism 21*a* includes an X-axis motor 22, an encoder 25 and an X-axis transmission mechanism 23. More specifically, the X-axis motor 22 and a reduction gear mechanism 24 are enclosed in the body cover 20 of the attachment 10 so as to be located on the right side of the fixing frame 16 as shown in FIGS. 4 and 5. The X-axis motor 22 is fixed to the underside of the fixing frame 16 and has a rotating shaft 22*a* extending through the fixing frame 16. A gear 24*a* brought into mesh engagement with the reduction gear mechanism 24 is secured to an upper part of the rotating shaft 22*a*. An X-axis encoder 25 (see FIG. 5) is mounted on a lower part of the X-axis motor 22. The reduction gear mechanism 24 is provided with a pulley 26 (see FIG. 4), and another pulley 27 is rotatably mounted on a left part of the fixing frame 16. An endless timing belt 28 extends between the pulleys 26 and 27. The timing belt 28 is connected to the first frame 17*a* of the moving frame 17.

When the moving table 11 is moved in the X direction, the motion of the moving table 11 is transmitted via the moving frame 17 and the timing belt 28 to the pulley 26, so that the reduction gear mechanism 24 is rotated. The X-axis motor 22 is rotated by the reduction gear mechanism 24. The X-axis transmission mechanism 23 is thus constituted by the reduction gear mechanism 24, the gear 24*a*, the pulleys 26 and 27, the timing belt 28 and the like.

The second displacement detection mechanism 21*b* includes a Y-axis motor 29, a Y-axis encoder 33 and a Y-axis transmission mechanism 30. More specifically, the Y-axis motor 29 is enclosed in the body cover 20 of the attachment 10 so as to be located under the first frame 17*a*. The reduction gear mechanism 31 is enclosed in the moving part cover 13*a* of the moving part 13 so as to be located on an upper face of the second frame 17*b*. The Y-axis motor 29 has a rotating shaft 29*a* extending through the first and second frames 17*a* and 17*b* in the up-down direction. A gear 31*a* brought into mesh engagement with the reduction gear mechanism 31 is secured to an upper part of the rotating shaft 29*a*. A Y-axis encoder 33 is mounted on a lower part of the Y-axis motor 29. Another pulley 34 is mounted on the reduction gear mechanism 31. A pulley 35 (see FIG. 4) is rotatably mounted on a rear part of the second frame 17*b*. An endless timing belt 36 extends between the pulleys 34 and 35. The timing belt 36 is connected to the carriage 14.

When the moving table 11 is moved in the Y direction, the motion of the moving table 11 is transmitted via the carriage 14 and the timing belt 36 to the pulley 34, so that the reduction gear mechanism 31 is rotated. The Y-axis motor 29 is rotated by the reduction gear mechanism 31. The Y-axis transmission mechanism 30 is thus constituted by the reduction gear mechanism 31, the pulleys 34 and 35, the timing belt 36 and the like. The X-axis transmission mechanism 23 and the Y-axis transmission mechanism 30 double as a transfer mechanism which transfers an embroidery frame attached to the carriage 14 in the X direction and the Y direction by driving the X-axis motor 22 and the Y-axis motor 29 respectively.

The X-axis encoder 25 is an optical rotary encoder comprising a rotating disc 25*a* and a photointerrupter 25*b*. The rotating disc 25*a* is fixed to a lower part of the rotating shaft 22*a* of the X-axis motor 22. The rotating disc 25*a* has a number of slits formed circumferentially at regular intervals. The photointerrupter 25*b* includes a light-emitting element and a light receiving element located opposite each other with the slits of the rotating disc 25*a* being interposed therebetween. The photointerrupter 25*b* supplies an A-phase signal and a B-phase signal to the control device 39. These A-phase and B-phase signals have respective phases shifted from each other. Thus, the X-axis encoder 25 detects an amount of rotation and a rotational direction of the X-axis motor 22.

The Y-axis encoder 33 is an optical rotary encoder comprising a rotating disc 33*a* and a photointerrupter 33*b* as the X-axis encoder 25. The rotating disc 33*a* is fixed to a lower part of the rotating shaft 29*a* of the Y-axis motor 29 and slit. The photointerrupter 33*b* supplies an A-phase signal and a B-phase signal to the control device 39. Thus, the Y-axis encoder 33 detects an amount of rotation and a rotational direction of the Y-axis motor 29. The control device 39 calculates amounts of rotation and rotational directions of the moving table 11 in the X direction and the Y direction, based on the detection signals of the encoders 25 and 33. A calculating manner will be described later. The control device 39, the encoders 25 and 33 and the like constitute a detection unit which detects an amount of movement and a moving direction of the workpiece cloth placed on the moving table 11.

The sewing machine M further includes a camera 38 provided in the head 3*a* as shown in FIG. 2. The camera 38 is an imaging unit comprising a CMOS image sensor and images the workpiece cloth placed on the bed 1. Images of the workpiece cloth are loaded as still images at predetermined intervals into the control device 39. The control device 39 compares the latest still image with a last one, thereby specifying an amount of movement and a moving direction of the workpiece cloth. The control device 39, the camera 38 and the like constitute a detection unit in the case where the moving table 11 is not used.

Figure 3B:
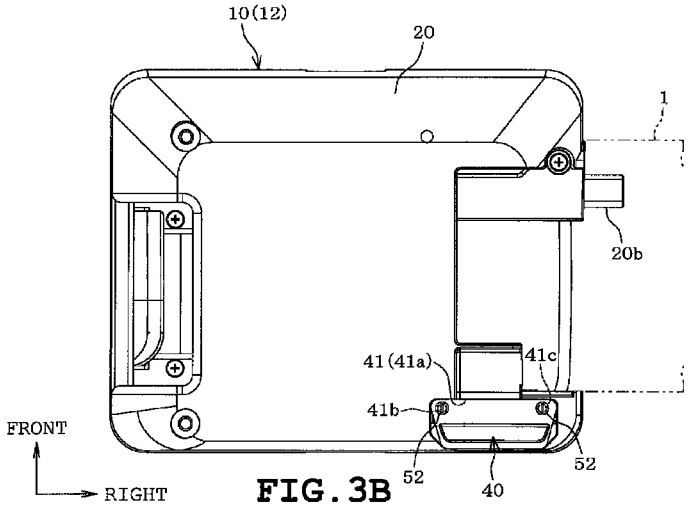
Figure 6A:
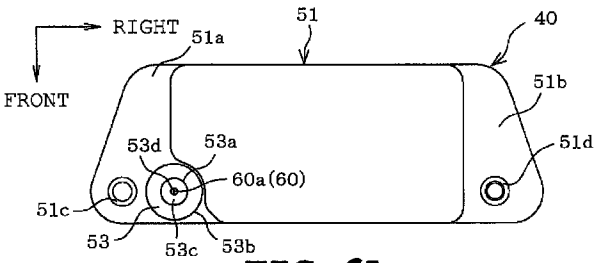
FIGS. 6A, 6B and 6C are a plan view, a front view and a right side view of a cutting unit respectively.

The attachment 10 is provided with a cutting unit 40 to form a cut in the workpiece cloth. A compartment 41 for housing the cutting unit 40 is formed in a right rear of the body cover 20 of the attachment 10. The compartment 41 defines a space by an upper surface 20*c* and a peripheral wall 41*a*. The cutting unit 40 is housed in the space. The cutting unit 40 is formed into a substantially trapezoidal shape in a planar view as shown in FIG. 6A. The compartment 41 is formed into a shape matching to the trapezoidal shape of the cutting unit 40 as shown in FIGS. 3A and 3B. Accordingly, when housed in the compartment 41, the cutting unit 40 is regulated in the orientation in the front-back direction thereby to be housed in the compartment 41 in a correct orientation.

The upper surface 20*c* of the compartment 41 has bosses 41*b* and 41*c* which are located at a forward corner and formed integrally with the compartment 41, as shown in FIG. 3A. The bosses 41*b* and 41*c* are formed into a right-and-left pair and a columnar shape. The bosses 41*b* and 41*c* protrude downward from the upper surface 20*c* and have lower ends formed with screw holes (not shown) extending in the up-down direction respectively. The upper surface 20*c* of the compartment 41 is formed with a circular hole 41*d* in a forward part thereof. The circular hole 41*d* is formed so as to be located in the rear of a needle location of the needle 5 when the attachment 10 has been attached to the bed 1.

Figure 6B:
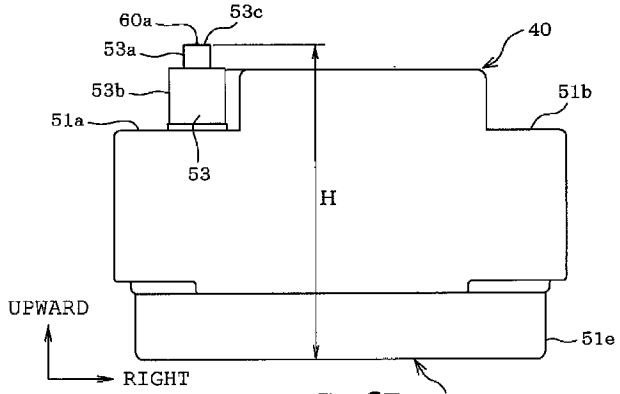

The cutting unit 40 will now be described with reference to FIGS. 6A, 6B and 6C. The cutting unit 40 includes an enclosure case 51 which is made of resin and formed into a horizontally long box shape. The enclosure case 51 is formed into a substantially trapezoidal shape in a planar view. The enclosure case 51 is mounted by screws (not shown) to a unit frame 56 which will be described later. The enclosure case 51 includes an upper part having stepped parts 51*a* and 51*b* at right and left ends thereof respectively. The stepped parts 51*a* and 51*b* are formed with through holes 51*c* and 51*d* respectively.

Figure 7:
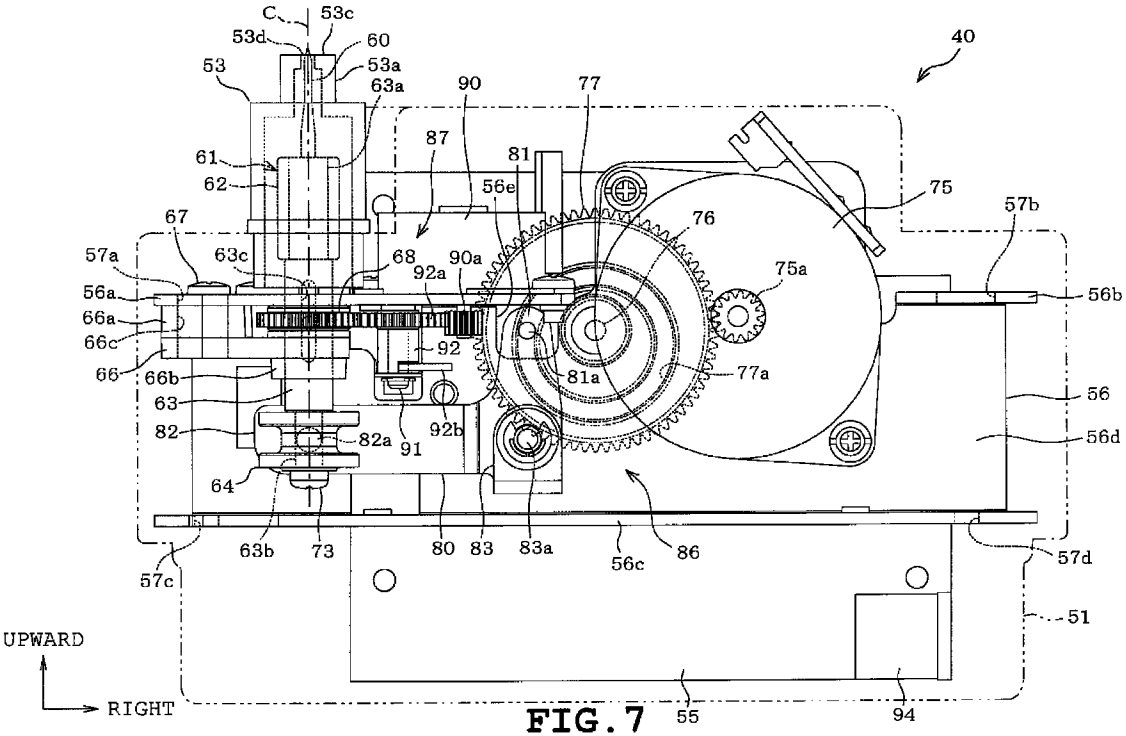
FIG. 7 is a front view of the cutting unit, showing an inner structure thereof.

An extending part 51*e* is formed on a lower part of the enclosure case 51. The extending part 51*e* extends downward in accordance with a base plate 55 (see FIG. 8) which will be described later. A connector opening 51*f* is formed in a right side of the extending part 51*e*. The enclosure case 51 has a substantially cylindrical needle case 53 formed on the left stepped part 51*a*. The needle case 53 includes an upper smaller-diameter part 53*a* and a lower larger-diameter part 53*b*. The smaller-diameter part 53*a* is fitted into the circular hole 41*d* of the compartment 41. The enclosure case 51 is set to a height H such that an upper surface of the smaller-diameter part 53*a* is coplanar with the upper surface 20*c* of the body cover 20 when housed in the compartment 41. Further, the smaller-diameter part 53*a* has an upper surface 53*c* formed with a hole 53*d* (see FIG. 6A). A cutting needle 60 as shown in FIG. 7 comes out of and into the hole 53*d*.

Figure 8:
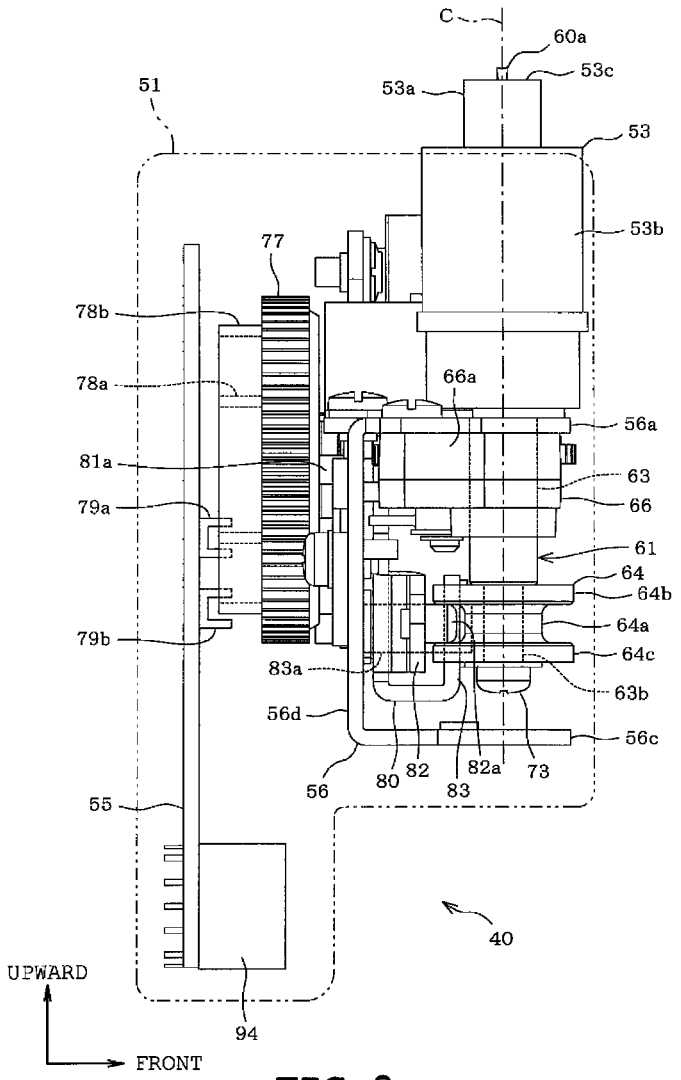
FIG. 8 is a left side view of the cutting unit.

The inner structure of the cutting unit 40 will now be described with reference to FIGS. 7 to 9. Note that the base plate 55 in the enclosure case 51 is eliminated and the inner structure of the cutting unit 40 is partially broken in the rear view of FIG. 9. The unit frame 56 is provided in the enclosure case 51. The unit frame 56 has a standing wall 56*d*, a left upper edge 56*a*, a right upper edge 56*b* and a lower edge 56*c*, all of which are formed integrally therewith. The standing wall 56*d* extends in the up-down direction. The left upper edge 56*a* extends forward from a left upper end of the standing wall 56*d*. The right upper edge 56*b* extends forward from a right upper end of the standing wall 56*d*. The lower edge 56*c* extends forward from a lower end of the standing wall 56*d*. The left upper edge 56*a* is formed with a through hole 57*a* as shown in FIG. 7. The right upper edge 56*b* is also formed with a through hole 57*b*. The holes 57*a* and 57*b* are located to correspond to the through holes 51*c* and 51*d* of the enclosure case 51 respectively. The holes 57*a* and 57*b* are formed so that bosses 41*b* and 41*c* are fittable with the holes 57*a* and 57*b* respectively. The lower edge 56*c* is formed with through holes 57*c* and 57*d* which are located to correspond to the screw holes formed in the distal ends of the bosses 41*b* and 41*c* respectively. The holes 57*c* and 57*d* have outer diameters which are smaller than outer diameters of the bosses 41*b* and 41*c*. The enclosure case 51 includes a lower part formed with through holes (not shown) which are located to correspond to the holes 57*c* and 57*d* respectively. The through holes of the enclosure case 51 have respective outer diameters equal to outer diameters of the holes 57*c* and 57*d*.

The following describes the case where the cutting unit 40 is housed in (or attached to) the compartment 41. As the cutting unit 40 is inserted into the compartment 41, the bosses 41*b* and 41*c* are inserted through the holes 51*c* and 51*d* of the enclosure case 51 and the holes 57*a* and 57*b* respectively. The distal (lower) ends of the bosses 41*b* and 41*c* then abut against an upper surface of the lower edge 56*c*. As a result, the unit frame 56 is positioned in the up-down direction with the result that the cutting unit 40 is positioned in the up-down direction. In this state, two screws as shown in FIG. 3B are inserted through the holes of the lower part of the enclosure case 51 and the holes 57*c* and 57*d* to be screwed into the screw holes of the bosses 41*b* and 41*c*, respectively. The screws 52 have heads having respective outer diameters larger than the outer diameters of the holes of the lower part of the enclosure case 51. Accordingly, the enclosure case 51 and the unit frame 56 are fixed to the bosses 41*b* and 41*c*. Thus, the cutting unit 40 is housed and fixed in the compartment 41. The screws 52 are loosened when the cutting unit 40 housed in the compartment 41 is detached.

A cutting needle support 61 is mounted on a left part of the unit frame 56 so as to extend through the left upper edge 56*a*. The cutting needle support 61 has the cutting needle 60. The cutting needle support 61 includes a support bar extending in the up-down direction, amounting cylindrical part 62 mounted on an upper part of the support bar 63 and a connecting part 64 mounted on a lower part of the support bar 63. The cutting needle 60 has a haft 60*b* (see FIG. 9) serving as a base and formed into a substantially round bar shape and a blade 60*a* constituting a distal end (an upper end) of the cutting needle 60, both of which are formed integrally with the cutting needle 60. The blade 60*a* has a blade edge having a predetermined width W (2 mm, for example) as shown in an enlarged view of FIG. 12A. In a stricter sense, the blade 60*a* is formed so that two widthwise ends 59*b* are slightly higher than a central part 59*a*. When the blade 60*a* forms a cut in the workpiece cloth CL, the ends 59*b* firstly come into contact with and cut into the workpiece cloth CL. Accordingly, the cut is formed by the blade 50*a* without displacement of the blade 60*a* relative to the workpiece cloth CL. The haft 60*b* has an outer periphery including a planar part 60*c* (see FIG. 9) although the planar part 60*c* is not shown in detail. As a result, the haft 60*b* has a D-cut shape, that is, a D-shaped cross-section perpendicular to the lengthwise direction thereof. The planar part 60*c* is formed to extend in a direction perpendicular to the direction (the right-left direction in FIG. 12) in which the blade 60*a* (the blade edge) extends.

Figure 9:
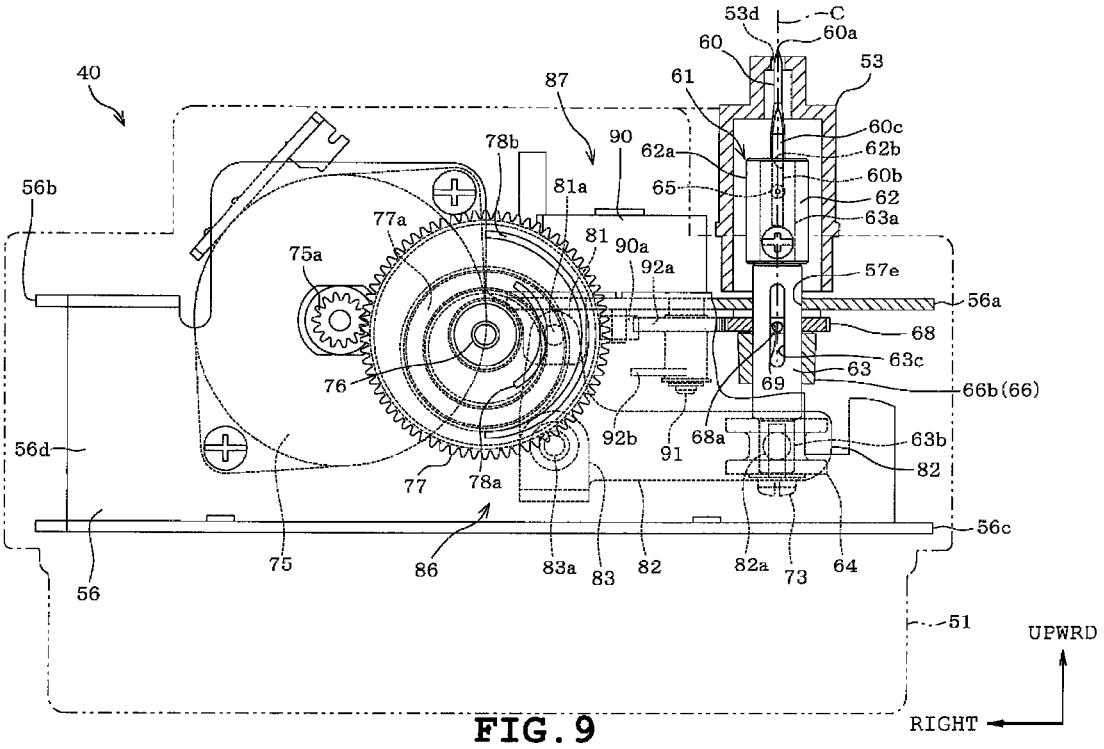
FIG. 9 is a partially broken rear view of the cutting unit, showing the inner structure thereof.

The support bar 63 includes a first smaller diameter part 63*a* constituting an upper part thereof as shown in FIG. 9. The support bar 63 also includes a second smaller diameter part 63*b* constituting a lower part thereof. The first smaller diameter part 63*a* is formed with an insertion groove 62*b* extending in the up-down direction. The insertion groove 62*b* has two sidewalls and an inner wall although these walls are not shown in detail. The insertion groove 62*b* has a generally U-shaped cross-section perpendicular to a lengthwise direction thereof. The insertion groove 62*b* has a width (a dimension between the sidewalls) that is slightly larger than an outer diameter of the haft 60*b*. The haft 60*b* of the cutting needle 60 is inserted into the insertion groove 62*b*. In this case, the planar part 60*c* of the haft 60*b* is brought into face-to-face contact with the inner wall of the insertion groove 62*b*. The mounting cylinder 62 for fixing the cutting needle 60 is attached to cover the first smaller diameter part 63*a* to be fixed to the first smaller diameter part 63*a*. The mounting cylinder 62 has aside (a rear surface in FIG. 9) formed with a screw hole (not shown), into which a screw 65 is screwed. When the screw 65 is tightened, a distal end of the screw 65 abuts against the haft 60*b* of the cutting needle 60 to press the haft 60*b*. Thus, the planar part 60*c* is pressed against the inner wall of the insertion groove 62*b* with the result that the cutting needle 60 is fixed to the first smaller diameter part 63*a*. The cutting needle 60 is thus mounted on the support bar 63 with the blade 60*a* being directed upward. The cutting needle 60 and the support bar 63 are configured so that a central axis line C of the cutting needle 60 corresponds with a central axis line of the support bar 63. The blade 60*a* has a widthwise central position located on the central axis line C.

The support bar 63 extends in the up-down direction through a through hole 57*e* (see FIG. 9) of the left upper edge 56*a* of the unit frame 56. Further, the support bar 63 is supported on a bearing member 66 so as to be movable up and down and rotatable. The bearing member 66 is fixed to the underside of the left upper edge 66*a* and has a left-half fixing part 66*a* and a right-half bearing part 66*b* both of which are formed integrally with the bearing member 66, as shown in FIG. 7. The fixing part 66*a* is fixed to the left upper edge 56*a* by a screw 67. The bearing part 66*b* supports the support bar 63 so that the support bar 63 is rotatable about the central axis line C. The fixing part 66*a* is formed with an insertion hole 66*c* having an inner diameter substantially equal to the outer diameter of the boss 41*b*. The boss 41*b* is inserted through the insertion hole 66*c* so as to be fitted therein almost without gap. More specifically, when the cutting unit 40 is housed in the housing part 41, the boss 41*b* is fitted into the insertion hole 66*c*, and the boss 41*c* is inserted into the insertion hole 57*b* of the right upper edge 56*b* so as to be fitted with the front and rear portions of the insertion hole 57*b*. Thus, the cutting unit 40 is positioned correctly relative to the body cover 20 of the attachment 10 with respect to the front-back direction and the right-left direction.

The support bar 63 has a middle part in the direction of the central axis line C. The middle part is formed with an elongate hole 63*c* extending in the direction of the central axis line C. A pin 69 which will be described later is inserted through the hole 63*c* so as to be movable up and down. A first gear 68 is rotatably supported by the middle part of the support bar 63. The first gear 68 is disposed between the left upper edge 56*a* of the unit frame 56 and the bearing part 66*b*. The first gear 68 has an inner periphery formed with a groove 68*a* as shown in FIG. 9. The groove 68*a* is open at the underside of the first gear 68. The pin 69 is fitted in the groove 68*a* and inserted through the hole 63*c* of the support 63. As a result, the first gear 68 rotated via the pin 69 together with the support bar 63 and allows up-and-down motion of the support bar 63. The hole 63*c* is formed to extend in a direction perpendicular to an inner wall of the insertion groove 62*b*. Accordingly, the pin 69 has a central axis line having a direction corresponding to the direction in which the blade 60*a* (the blade edge) extends.

A connecting part 64 is provided under the support bar 63. The connecting part 64 is connected to a first engagement pin 82*a* of a swing link 80 which will be described later. The connecting part 64 has a cylindrical portion 64*a* and a pair of flanges 64*b* and 64*c* all of which are formed integrally therewith, as shown in FIG. 8. The cylindrical portion 64*a* is inserted into the second smaller diameter portion 63*b* of the support bar 63. The flanges 64*b* and 64*c* are formed on upper and lower ends of the cylindrical portion 64*a* respectively. The second smaller diameter portion 63*b* has a lower end formed with a screw hole (not shown) extending in the up-down direction. The connecting part 64 is fixed by a screw 73 screwed into the screw hole from below the second smaller diameter portion 63*b* while inserted in the second smaller diameter portion 63*b*. The flanges 64*b* and 64*c* are each formed into a disc shape such that the flanges 64*b* and 64*c* hold the first engagement pin 82*a* vertically therebetween. A distance between the flanges 64*b* and 64*c* is set to be slightly larger than an outer diameter of the first engagement pin 82*a*. Accordingly, the connecting part 64 is maintained in engagement with the first engagement pin 62*a* even when rotated together with the support bar 63.

The following will describe the construction for driving the cutting needle support 61 up and down. A first motor 75 is mounted on the standing wall 56*d* of the unit frame 56 backward so as to be located at a slightly upper rightward position. The first motor 75 is a stepping motor, for example and has an output shaft to which a smaller diameter driving gear 75*a* is fixed, as shown in FIG. 9. Further, a gear shaft 76 extending rearward is mounted on the standing wall 56*d* so as to be located at a centrally upper rightward position. A larger diameter driven gear 77 is rotatably mounted on the gear shaft 76. The driven gear 77 is brought into mesh engagement with the driving gear 55*a*. The driven gear 77 has a grooved cam 77*a* formed in a front thereof as shown in FIG. 7. The grooved cam 77*a* has an annular shape eccentric to the gear shaft 76. The grooved cam 77*a* engages a first engagement pin 81*a* of a swing link 80 which will be described later.

On the other hand, the driven gear 77 has a rear provided with a first arc portion 78*a* and a second arc portion 78*b* formed integrally therewith, as shown in FIG. 9. The first and second arc portions 78*a* and 78*b* are concentric and are each formed into the shape of a thin rib protruding rearward. The base plate 55 is opposed to the standing wall 56*d* of the unit frame 56 and disposed in the rear of the first and second arc portions 78*a* and 78*b*. The base plate 55 includes vertical position sensors 79*a* and 79*b* corresponding to the first and second arc portions 78*a* and 78*b* respectively. The vertical position sensors 79*a* and 79*b* detect rotation angles of circumferential ends of the first and second arc portions 78*a* and 78*b* respectively. The vertical position sensors 79*a* and 79*b* are comprised of photointerrupters respectively. Rotation angles of the first and second arc portions 78*a* and 78*b* are detected by the vertical position sensors 79*a* and 79*b* respectively, whereby a horizontal position of the first engagement pin 81*a* engaging the grooved cam 77*a* is determined. Thus, the control device 39 detects a vertical position of a second engagement pin 82*a* which will be described later. A vertical position of the cutting needle 60 is determined based on the determination of the vertical position of the second engagement pin 82*a*. Thus, the control device 39 detects the vertical position of the cutting needle 60 based on the detection of rotational angles of the first and second arc portions 78*a* and 78*b* by the vertical position sensors 79*a* and 79*b*.

The swing link 80 is disposed along a front surface of the standing wall 56*d* in the unit frame 56 as shown in FIG. 7. In this case, the swing link 80 is located between the driven gear 77 and the connecting part 64 of the cutting needle support 61. Further, a frontwardly extending pivotably-supporting shaft 83*a* is mounted on a lower central part of the standing wall 56*d*. The swing link 80 is pivotably supported by the shaft 83*a* so as to be swingable. The swing link 80 is constructed of a plate-shaped member and includes an upwardly extending upper arm 81 and a leftwardly extending left arm 82 both of which are formed into an inverted L-shape. The swing link 80 further includes a supported part (a proximal end) which is folded back to the front side thereby to be formed into a U-shape in a side view as shown in FIG. 8. The supported part is provided with a folded piece 83 having a through hole (not shown) through which the shaft 63*a* extends.

The upper arm 81 has an upper end from which a first engagement pin 81*a* protrudes. The engagement pin 81*a* is located at a rear surface side facing an upper cutout 56*e* (see FIG. 7). The first engagement pin 81*a* is inserted into the grooved cam 77*a* of the driven gear 77 thereby to be in engagement with the grooved cam 77*a*. On the other hand, the left arm 82 has a left end from which a second engagement pin 82*a* protrudes. The second engagement pin 82*a* is located at the front surface side so as to be aligned with the connecting part 64. The second engagement pin 82*a* is held between the flanges 64*b* and 64*c* of the connecting part 64 to be in engagement with the flanges 64*b* and 64*c*.

Upon drive of the first motor 75, the driven gear 77 is rotated via the driving gear 75*a*. The first engagement pin 81*a* engaging the grooved cam 77*a* is moved in the right-left direction (reciprocal movement) with the result that the swing link 80 is swung about the shaft 83*a*. The swing of the swing link 80 moves the second engagement pin 82*a* in the up-down direction (reciprocal movement). The connecting part 64 is moved in the up-down direction by the second engagement pin 82*a* moved in the up-down direction. Thus, the cutting needle support 61 is moved up and down by driving the first motor 75, so that the cutting needle 60 is moved reciprocally between a top dead point and a bottom dead point. When the cutting needle 60 is located at the top dead point, the blade 60*a* projects from the top 53*c* of the enclosure case 51 (the upper surface 20*c* of the embroidery frame transfer device 13). When the cutting needle 60 is located at the bottom dead point, the blade 60*a* is located below the top 20*c*. An amount of projection of the blade 60*a* is set to, for example, 5 mm when the cutting needle 60 is located at the top dead point. A cutting needle up-down motion mechanism 86 moving the cutting needle 60 up and down are thus constructed of the first motor 75, the gears 75*a* and 77, the grooved cam 77*a*, the swing link 80, the cutting needle support 61 and the like.

The cutting unit 40 includes a rotating mechanism 87 which rotates the cutting needle 60 about the central axis line C. In more detail, a second motor 90 is mounted on the left upper edge 56*a* of the unit frame 56 to a downward direction so as to be located in the right of the cutting needle support 61. The second motor 90 is a stepping motor, for example. The second motor 90 has an output shaft to which a smaller diameter driving gear 90*a* is fixed. A downwardly extending gear shaft 91 is mounted on the left upper edge 56*a* of the unit frame 56 so as to be located between the cutting needle support 61 and the second motor 90. A driven gear 92 is rotatably mounted on the gear shaft 91.

The driven gear 92 has a cylindrical part through which the gear shaft 91 is inserted, a first gear 92*a* mounted on an upper end of the cylindrical part and a sectorial part 92*b* formed in a lower end of the cylindrical part, all of which are formed integrally with the driven gear 92, as shown in FIG. 7. The sectorial part 92*b* is formed into the shape of a plate with an arc-shaped outer periphery in a planar view. A rotation angle sensor 93 (shown only in FIG. 10) is provided on the standing wall 56*d* of the unit frame 56. The rotation angle sensor 93 detects a rotation angle of a circumferential end of the sectorial part 92*b*. The rotation angle sensor 93 is configured of a photointerrupter. The control device 39 detects a rotation angle of the blade 60*a* of the cutting needle 60 based on a detection signal of the rotation angle sensor 93.

The first gear 92*a* of the driven gear 92 is brought into mesh engagement with both the driving gear 90*a* of the second motor 90 and the first gear 48 of the cutting needle support 61. The first gear 92*a* has gear teeth the number of which is equal to that of the second gear 68. The driving gear 90*a*, the first gear 92*a* and the second gear 48 constitute a gear train constructed by combining the three spur gears. Accordingly, the driving gear 90*a* has a rotation direction that is the same as a rotation direction of the second gear 68. When the second motor 90 is driven for normal rotation or for reverse rotation, the first gear 92*a* is rotated via the driving gear 90*a*. The second gear 68 is rotated together with the cutting needle support 61 with rotation of the first gear 92*a*. Further, the first gear 92*a* has the gear teeth the number of which is equal to that of the second gear 68 as described above. When the first gear 92*a* is rotated one turn, the second gear 68 is also rotated one turn accordingly. Therefore, a rotation angle of the second gear 68 is detected by detecting a rotation angle of the first gear 92*a*. The rotation angle of the second gear 68 accordingly corresponds to a rotation angle of the blade 60*a* of the cutting needle 60.

Thus, the second motor 90, the gears 68, 90*a* and 92*a* and the like constitute a rotating mechanism 87 which rotates the cutting needle 60 about the central axis line C. The up-down motion mechanism 86, the rotating mechanism 87 and the like are assembled to the unit frame 56 to constitute one unit housed in the enclosure case 51 together with the cutting needle 60, that is, the cutting unit 40.

In attaching the cutting unit 40, the user puts the cutting unit 40 into the compartment 41 from the underside of the attachment 10 while the cutting unit 40 is oriented so that the needle case 53 side is located upward (see FIG. 3A). The cutting unit 40 is fixed by the screws 32. Thus, the cutting unit 40 is attached to the compartment 41 of the attachment 10 with the blade 60*a* of the cutting needle 60 being directed upward. Further, when the cutting unit 40 has been attached to the compartment 41, the cutting needle 60 is moved up and down at a location spaced rearward from the needle location 1*b* of the needle 5 by distance G (see FIG. 3A).

Figure 6C:
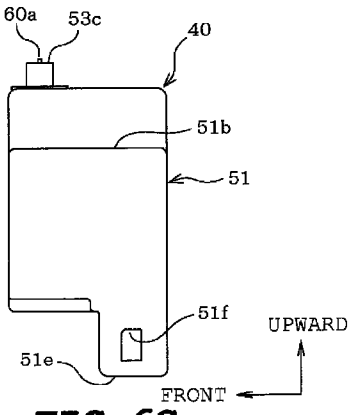

A connector 94 is mounted in a right lower part of the base plate 35 in the cutting unit 40 (see FIGS. 6C and 7). The connector 94 faces the connector opening 51*f* of the enclosure case 51. When the cutting unit 40 has been attached to the compartment 41, a cable (not shown) connected to the connector 94 is further connected to a connector (not shown) provided on the rear or the right side of the sewing machine M. As a result, electrical components such as the motors 75 and 90 and the sensors 79*a*, 79*b* and 93 in the cutting unit 40 are electrically connected to the control device 39 of the sewing machine M.

Figure 10:
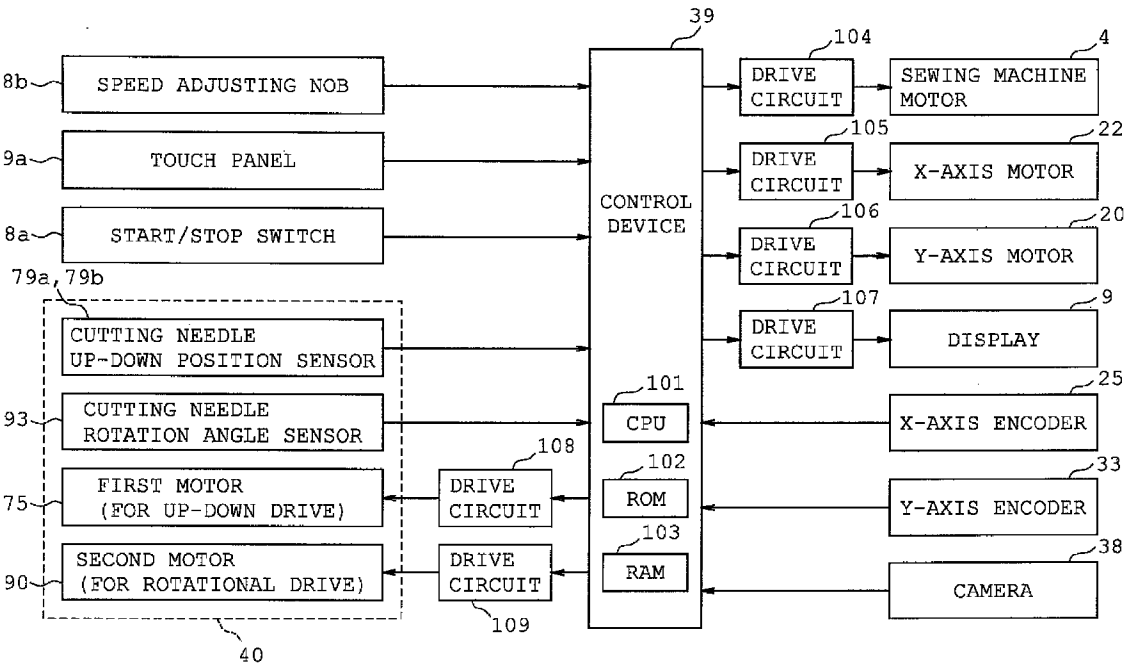
FIG. 10 is a block diagram showing an electrical arrangement of the sewing machine.

The control system of the sewing machine M will now be described with reference to FIG. 10. The control device 39 is configured to be microcomputer-centric and includes a CPU 101, a ROM 102 and a RAM 103. To the control device 39 are connected the start/stop switch 8*a*, the speed adjusting knob 8*b*, the touch panel 9*a*, the X-axis encoder 25, the Y-axis encoder 33 and the camera 38. To the control device 39 are also connected drive circuits 104, 105, 106 and 107 driving the sewing machine motor 4, the X-axis motor 22, the Y-axis motor 29 and the display 9 respectively. Further, the vertical position sensors 79*a* and 79*b* and the rotation angle sensor 93 are connected to the control device 39. Drive circuits 108 and 109 driving the first motor 75 and the second motor 90 are connected to the control device 39 respectively.

The ROM 102 stores embroidery data of various types of embroidery patterns, cutting data, a sewing control program, cutting control program and the like. The embroidery data specifies a needle location for every stitch to sew an embroidery pattern on the workpiece cloth using the sewing needle 5 as well known in the art. More specifically, an X-Y coordinate system is defined in the sewing machine M. The X-Y coordinate system has an origin which is a location where a central point (not shown) of a sewable region automatically set according to a type of the embroidery frame corresponds with the needle location 1*b*. The embroidery data has coordinate data based on which the sewing needle 5 is caused to drop sequentially, as needle location data defined by the X-Y coordinate system (embroidery coordinate system) and indicative of an amount of transfer of the embroidery frame in the X direction and the Y direction. The control device 39 controls the sewing machine motor 4, the X-axis motor 22 and the Y-axis motor 29 based on the embroidery data thereby to automatically perform an embroidery sewing operation for the workpiece cloth.

The cutting data is provided for forming a predetermined cut pattern by the cutting needle 60 on the workpiece cloth held on the embroidery frame. The cutting data includes cut position data and angle data. The cut position data is indicative of an amount of transfer of the embroidery frame in the X direction and the Y direction thereby to denote a cut position for every vertical reciprocal movement of the cutting needle 60. The angle data is set to correspond to the cut position data and denotes a rotation angle (a cut angle) for every vertical movement of the cutting needle 60. The control device 39 controls the X-axis motor 22, the Y-axis motor 29, the first motor 7 and the second motor 90 based on the cutting data, thereby automatically performing a cutting operation for the workpiece cloth.

Figure 11:
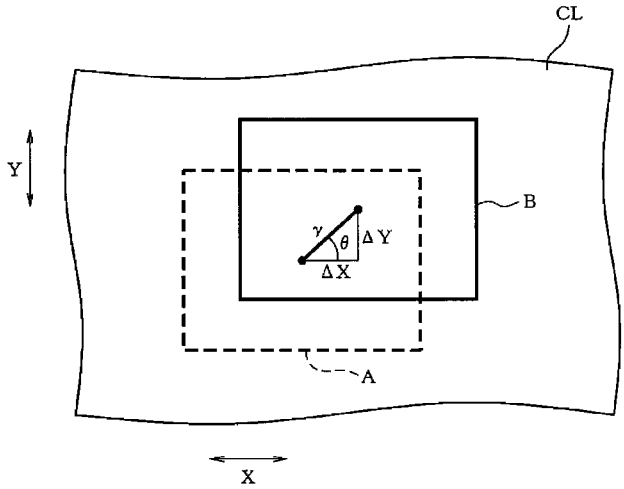
FIG. 11 is an illustration diagram showing the relationship between a still image of workpiece cloth and a rotational angle of a cutting needle.
Figure 12A:
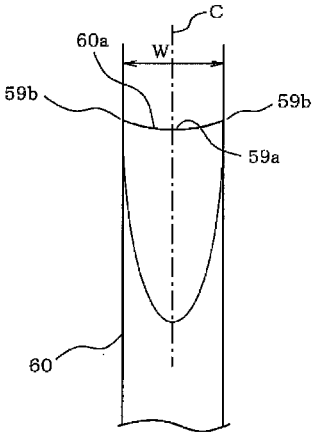
FIGS. 12A and 12B are an enlarged side view and an enlarged front view of the blade edge side of the cutting needle respectively.
Figure 12B:
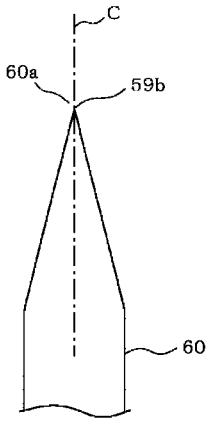

The rotation angle is indicative of a rotation angle of the cutting needle 60 about a central axis line C and is represented by an angle θ made by the cutting needle 60 and the X direction (see FIG. 11). In this case, the central axis line C is perpendicular to the plane of paper of FIG. 11. The rotation angle θ in the figure is positive (+) in the counterclockwise direction and negative (−) in the clockwise direction. Further, in the aforesaid XY coordinate system, the direction from left to right of the sewing machine M (rightward on the paper of FIG. 11) is indicated by the positive (+) direction on the X axis, and the direction from front to back (upward on the paper of FIG. 11) is indicated by the negative (−) direction on the Y axis.

The sewing machine M is configured to perform a plurality of operation modes including a practical sewing mode, an embroidery sewing mode, a cutting mode and a free motion mode. In the practical sewing mode, sewing is performed while the feed dog is moved forward and backward with the attachment 10 being unattached. On the other hand, in the embroidery sewing mode and the cutting mode, the workpiece cloth held by the embroidery frame is sewn or cut with the attachment 10 being attached, although detailed description of both modes will be eliminated. In the free motion mode, the workpiece cloth is sewn or cut with the attachment 10 being attached and without attachment of the embroidery frame while the user moves the workpiece cloth in any direction. The sewing performed while the user moves the workpiece cloth in any direction is referred to as "free motion stitching." For example, the configuration disclosed by Japanese patent application publication, JP-A-2009-189626, the application of which was filed by the applicant of the present application, may be employed regarding the free motion stitching, although detailed description will be eliminated. Further, the cutting performed while the user moves the workpiece in any direction is referred to as "free motion cutting."

In the free motion cutting, the control device 39 specifies a moving direction of the workpiece cloth in the case where the user moves the workpiece cloth in any direction, and the control device 39 controls a rotating mechanism 87 so that the direction of the blade 60*a* is changed according to the specified moving direction. The up-down drive mechanism 86 is driven to vertically reciprocate the cutting needle 60, thereby forming a cut in the workpiece cloth according to a moving direction of the workpiece cloth by the blade 60*a* of the cutting needle 60. The moving direction of the workpiece cloth is specified based on an image of the workpiece cloth taken by the camera 38 or detection signals generated by the encoders 25 and 33 in the case where the moving table 11 is moved with the workpiece cloth being placed on the moving table 11. In the following description of the working, the moving direction is to be specified based on an image of workpiece cloth taken by the camera 38. A fourth embodiment will describe a manner of specifying the moving direction of the workpiece cloth using the moving table 11.

When the free motion cutting is carried out, the user attaches the attachment 10 with the cutting unit 40 to a free arm bed of the bed 1. The embroidery frame or the moving table 11 is not set on the carriage 14. The user then places a workpiece cloth as an object to be processed on the bed 1. The user further operates the touch panel 9*a* to select the cutting control in the free motion mode. As a result, the control device 39 starts the cutting control in the free motion mode.

Figure 13:
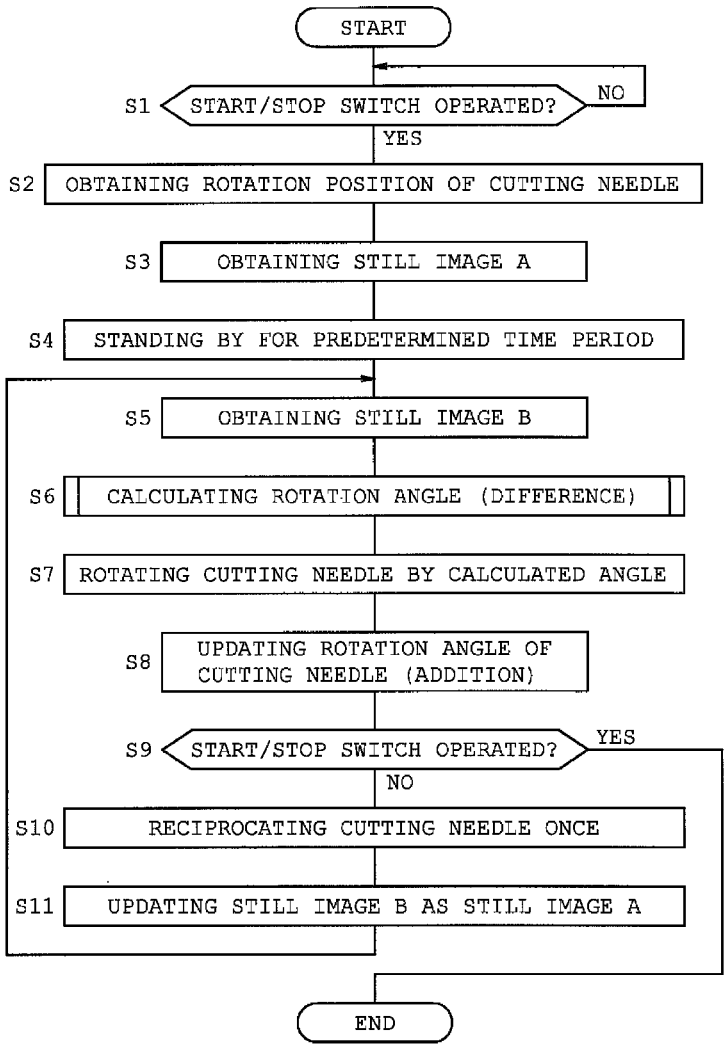
FIG. 13 is a flowchart showing cutting control under a free motion mode.

Referring to FIG. 13 showing processing procedure on a cutting control program in the free motion mode, when determining that the start/stop switch 8*a* has been operated by the user (YES at step S1), the control device 39 detects a rotation angle of the cutting needle 60 based on the detection signals of the rotation angle sensor 93 (step S2). Data of the detected rotation angle is stored in a rotation angle storage area of a RAM 103 by the control device 39. The control device 39 then controls the camera 38 so that the workpiece cloth on the bed 1 is imaged. In this case, the control device 39 reads an image of the workpiece cloth CL as shown in FIG. 11 as a still image A, storing the image in a first image storage area of the RAM 103 (step S3). Subsequently, the control device 39 stands by for a predetermined time (0.2 seconds, for example) and controls the camera 38 so that the workpiece cloth CL is again imaged by the camera 38 (steps S4 and S5). The obtained image of the workpiece cloth CL is stored as a still image B in a second image storage area of the RAM 103. The control device 39 then specifies a moving direction of the workpiece cloth CL based on the still images A and B, performing a process of obtaining a rotation angle of the cutting needle 60 (step S6).

More specifically, the still images A and B are read at predetermined time intervals. Accordingly, when the workpiece cloth CL is moved by the user during the time interval, displacement of the image occurs according to an amount of movement (see symbols ΔX and ΔY in FIG. 11). The control device 39 then measures displacements in the X direction and the Y direction by the number of pixels with respect to pixels composing the still images A and B. Since a known method can be employed for measurement of displacements of the image, a detailed description of the measuring manner will be eliminated. The control device 39 further converts the numbers of pixels in the X direction and the Y direction, measured as the displacements into values corresponding to amounts of movement of the workpiece cloth CL on the bed 1 in the X direction and the Y direction respectively. When symbols, ΔX and ΔY denote converted movement amounts in the X direction and the Y direction respectively, a movement direction θ1 of the workpiece cloth CL is calculated from the following equation (1), for example:

$$\theta 1=\tan^{-1}(\Delta Y/\Delta X) \quad (1)$$

The control device 39 then calculates the difference Ψ (=θ1−θ0) between θ1 obtained from equation (1) and the rotation angle θ0 of the cutting needle 60 obtained at step S2. The control device 39 drives the rotational drive mechanism 87 to rotate the cutting needle 60 with the calculated difference Ψ serving as a rotation angle, changing the rotation angle from θ0 to θ1 (step S7). The control device 39 further updates the rotation angle in the rotation angle storage area of the RAM 103 from θ0 to θ1 added with the difference Ψ (step S8).

When determining that the start/stop switch 8*a* has not been operated by the user (NO at step S9), the control device 39 drives the up-down drive mechanism 86 to vertically reciprocate the cutting needle 60 once (step S10). At this time, the cutting needle 60 is moved upward from below, so that the blade 60*a* penetrates through the workpiece cloth CL from below thereby to form a cut L1. After having formed the cut L1, the cutting needle 60 is moved downward from above thereby to be spaced downward from the workpiece cloth CL. The cut L1 shown in FIG. 14A has a length corresponding to the width W of the blade 60*a* and has an angle θ1 made along the moving direction (curved line shown by arrow in FIG. 14A) of the workpiece cloth CL at the cut position P1. Subsequently, the control device 39 stores (updates) the still image A in the first image storage area of the RAM 103 (step S11), returning to step S5.

The control device 39 causes the camera 38 to image the workpiece cloth CL again. The control device 39 then stores an obtained image of the workpiece cloth CL in a second image storage area of the RAM 103 as a still image B (step S5). The control device 39 further calculates X-direction and Y-direction movement amounts ΔX and ΔY of the workpiece cloth CL, based on the still image A in the first image storage area and the still image B in the second image storage area, obtaining a moving direction θ2 of the workpiece cloth CL. The control device 39 further calculates the difference Ψ (=θ2−θ1) between the movement direction θ2 and the rotation angle θ1 stored in the RAM 103. The control device 39 then drives the rotational drive mechanism 87 to rotate the cutting needle 60 with the result that the rotation angle of the cutting needle 60 is changed from θ1 to θ2 (step S7). The rotation angle in the rotation angle storage area of the RAM 103 is updated from θ1 to θ2 (step S8).

Figure 14A:
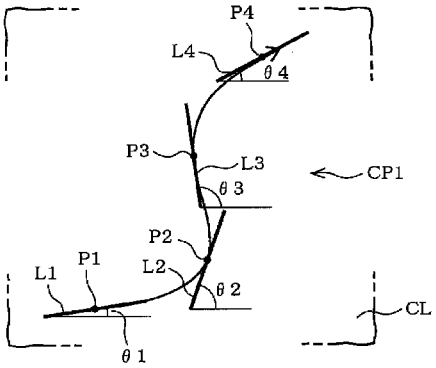
FIGS. 14A, 14B and 14C are diagrams exemplifying the relationship among a moving direction of the workpiece cloth, the rotational angle of the cutting needle and a cut position.

When determining that the start/stop switch 8*a* has not been operated by the user (NO at step S9), the control device 39 drives the up-down drive mechanism 86 to reciprocate the cutting needle 60 once. As a result, a second cut L2 is formed at a cut position P2 as shown in FIG. 14A and has an angle θ2 made along the moving direction of the workpiece cloth CL (step S10). Subsequently, the control device 39 proceeds to step S11 to write the still image B onto a first image storage area of the RAM 103 to store the still image B as the still image A, returning to step S5. Steps S5 to S11 are thus executed repeatedly, so that cuts L2, L4, . . . having angles θ3, θ4, . . . in the moving direction of the workpiece cloth CL are formed at third and subsequent cut positions P3, L4, . . . respectively. The control device 39 completes the process (END) when determining at step S9 that the start/stop switch 8*a* has been operated (YES).

A time period between the reciprocation of the cutting needle 60 and re-reciprocation of the cutting needle 60 (that is, a time period required for execution of steps S5 to S11) is 0.2 seconds, for example. The cuts L1, l2, . . . are formed at this time intervals. Accordingly, when the user moves the workpiece cloth CL at a relatively slower speed (a first speed), the intervals (pitch lengths) between adjacent cut positions P1, P2, . . . are rendered longer, as shown in FIG. 14A. In other words, when the workpiece cloth CL is moved at the first speed, the movement amount of the workpiece cloth CL for a unit time is increased with the result of an increase in the pitch length, so that a perforated (dashed) cut pattern CP1 is formed.

Figure 14B:
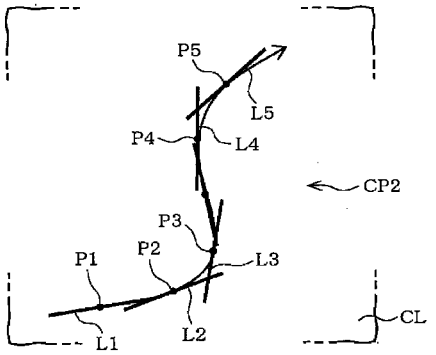
Figure 14C:
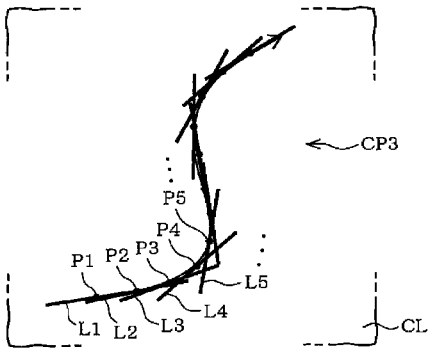

Further, the pitch length is rendered longer when the user moves the workpiece cloth CL at a speed (a second speed) further slower than the first speed, as shown in FIG. 14B. In other words, when the workpiece cloth CL is moved at the second speed, the movement amount of the workpiece cloth CL for the unit time is reduced with the result that the pitch length becomes equal to or shorter than the width W of the blade 60*a*, so that a cut pattern CP2 is formed by continuous cuts L1, L2, . . . . Further, when the user moves the workpiece cloth CL at a speed still further slower than the second speed, the movement amount of the workpiece cloth CL for the unit time is further reduced, as shown in FIG. 14C. Accordingly, the pitch length is rendered still further shorter with the result that a cut pattern CP3 is formed by densely continuous cuts L1, L2, . . . . When the user keeps the workpiece cloth CL still without movement, the movement amounts ΔX and ΔY become zero and a rotation angle as the difference Ψ also becomes zero, with the result that the cutting needle 60 repeats the vertical movement at the same cut position.

The sewing machine M as described above includes the control unit which controls the up-down movement of the cutting needle 60 by the up-down drive mechanism 86 and rotation of the cutting needle 60 by the rotational drive mechanism 87. Based on the results of detection by the detection unit, the control unit controls the rotational drive mechanism 87 so that the direction of the blade 60*a* is changed according to the moving direction of the workpiece cloth CL.

According to the above-described configuration, the moving direction of the workpiece cloth CL is detected by the detection unit when the user moves the workpiece cloth CL on the bed in any direction. In this case, the cutting needle 60 is rotated by the rotational drive mechanism 87 so that the direction of the blade 60*a* is changed according to the moving direction of the workpiece cloth CL based on the results of detection by the detection unit. When the up-down drive mechanism 86 is driven to reciprocate the cutting needle 60 in the up-down direction, a cut can be formed in the workpiece cloth CL by the blade 60*a* of the cutting needle 60 according to the moving direction of the workpiece cloth CL. Thus, the rotation and the up-down movement of the cutting needle 60 are repeated while the workpiece cloth CL is moved in any direction, so that a plurality of cuts is formed along the moving direction of the workpiece cloth CL. Thus, the workpiece cloth CL can be cut in a desired cut pattern by the free motion.

The detection unit includes the imaging unit which images the workpiece cloth CL placed on the bed. The imaging unit images the workpiece cloth CL every reciprocation of the cutting needle 60. The detection unit detects the movement amounts ΔX and ΔY and the moving direction of the workpiece cloth CL every reciprocation of the cutting needle 60, based on two images (the still images A and B) obtained before and after one reciprocation of the cutting needle 60. According to this configuration, the movement amounts ΔX and ΔY and the moving direction of the workpiece cloth CL are detected every reciprocation of the cutting needle 60, so that the direction of blade 60*a* can be oriented to the moving direction θ. Consequently, the workpiece cloth CL can be formed with a clearer cut pattern. Further, the movement amounts ΔX and ΔY and the moving direction θ of the workpiece cloth CL can be detected by a simple configuration using the images obtained by the imaging unit.

The cutting unit 40 includes the cutting needle 60, the up-down drive mechanism 86 and the rotational drive mechanism 87 and is mounted on the attachment 10. According to this configuration, the cutting function by the cutting needle 60 can easily be added to the attachment 10 in addition to a function as an original embroidering device.

Figure 15:
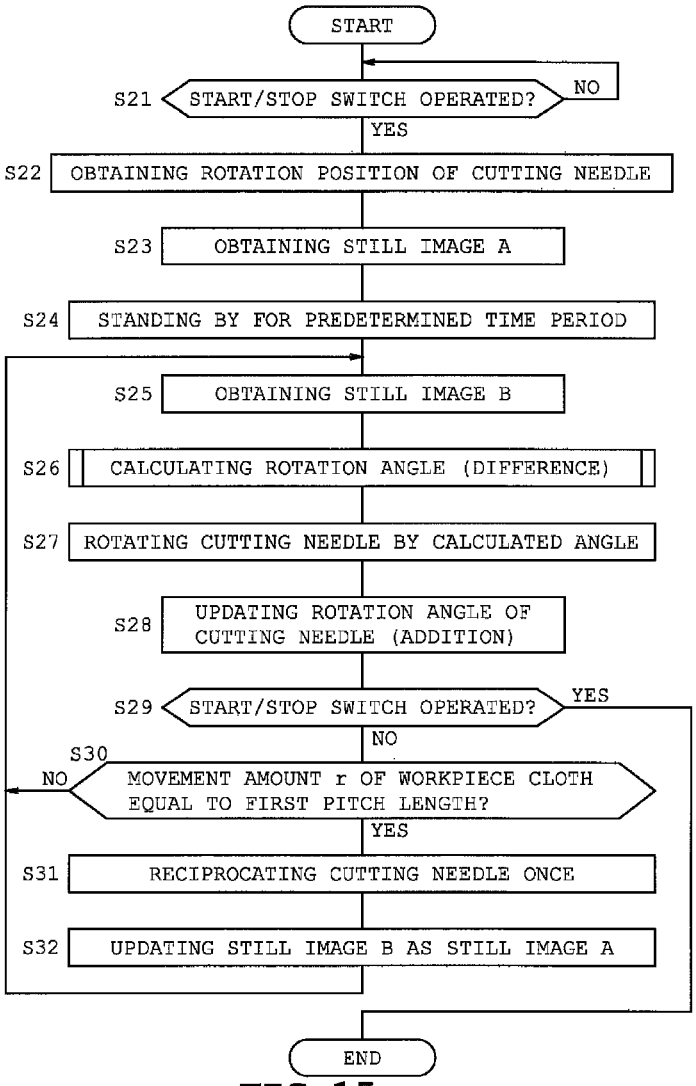
FIG. 15 is a view similar to FIG. 13, showing a second embodiment.

FIG. 15 illustrates a second embodiment. Only the differences between the first and second embodiments will be described. Identical or similar parts in the second embodiment will be labeled by the same reference symbols as those in the first embodiment. In the first embodiment, the pitch length of the cuts can optionally be changed according to the movement amount (moving speed) of the workpiece cloth CL as shown in FIGS. 14A to 14C. However, when the movement amount is not constant, the pitch length varies to become irregular with the result that the cuts look unattractive.

In view of the foregoing, the cutting control program employed in the second embodiment includes a default on the pitch length. The default is a set value usable to set the intervals of cuts formed in the workpiece cloth CL, namely, the pitch length to a predetermined first pitch length (2 mm, for example). A setting screen (not shown) to set the first pitch length may be displayed on the display 9 so that the first pitch length is set to an optional value by touch operation onto the touch panel 9*a*. The control device 39 executing the cutting control program in the second embodiment, the touch panel 9*a*, the display 9 and the like constitute a first pitch setting unit which sets the pitch length to the first pitch length.

Referring to FIG. 15, the processing flow of the cutting control program in the second embodiment is shown. Substantially the same processing as steps S1 to S11 in the first embodiment is carried out at all the steps except step S30, that is, steps S21 to S29, S31 and S32 in the second embodiment. More specifically, when the start/stop switch 8*a* has been operated (YES at step S21), the control device 39 detects a rotation angle of the cutting needle 60 (step S22) as described above. The control device 39 then obtains still images A and B of the workpiece cloth CL (steps S23 to S25). Based on the still images A and B, the control device 39 specifies a moving direction of the workpiece cloth CL and performs processing to obtain a rotation angle of the cutting needle 60 (step S26). In this case, the control device 39 calculates a movement amount of the workpiece cloth CL as a movement distance r as shown in FIG. 11 based on the still images A and B. The movement distance r can be obtained from the x-direction movement amount ΔX and the Y-direction movement amount ΔY:

$$r=(\Delta X^2+\Delta Y^2)^{1/2} \quad (2)$$

The control device 39 further calculates the difference Ψ between the movement direction θ1 obtained from the equation (1) and the rotation angle θ0 of the cutting needle 60 obtained at step S22. As a result, the control device 39 drives the rotational drive mechanism 87 to rotate the cutting needle 60 with the difference Ψ serving as a rotation angle (step S27). The control device 39 then updates the rotation angle θ0 to θ1 (step S28).

When the start/stop switch 8*a* has not been operated (NO at step S29) and the movement amount of the workpiece cloth CL has reached the first pitch length, the control device 39 reciprocates the cutting needle 60 once. More specifically, the control device 39 determines at step S30 whether or not the movement distance r equals the first pitch length commensurate with the width W of the blade 60*a*. When the movement distance r is not equal to the first pitch length, that is, shorter than the first pitch length (NO at step S30), the control device 39 repeats steps S25 to S30. As a result, the control device 39 sets the cutting needle 60 to a rotation angle according to the moving direction of the workpiece cloth CL based on the latest still image B. When determining that the movement distance r equals the first pitch length (YES at step S30), the control device 39 drives the up-down drive mechanism 86 to reciprocate the cutting needle 60 once (step S31). Subsequently, the control device 39 stores the still image B in the RAM 103 as the still image A at step S31, returning to step S25.

Figure 17A:
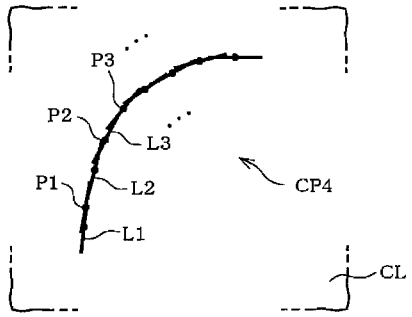
FIGS. 17A, 17B and 17C are diagrams exemplifying a cut pattern by the cutting needle.
Figure 17B:
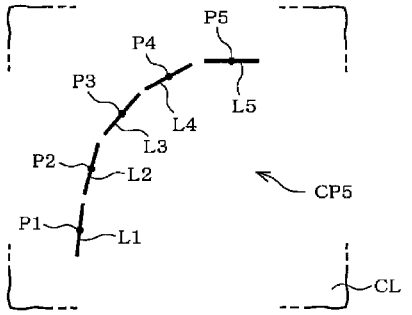

Thus, the repeated steps S25 to S32 produce a cut pattern (not shown) on the workpiece cloth CL, which cut pattern has the pitch length equal to the width W of the blade 60*a* and is composed of continuous cuts. FIG. 17A shows a cut pattern CP4 having the first pitch length set to a value smaller than the width W of the blade 60*a*. FIG. 17B shows a cut pattern CP5 having the first pitch length set to a value larger than the width W. Each one of the cut patterns CP4 and CP5 includes a plurality of cuts having an orientation according to the moving direction of the workpiece cloth CL and a constant pitch length. The cuts adjacent to one another are continuous in the cut pattern CP4. On the other hand, the cut pattern CP5 is composed of the cuts separate from one another thereby to be formed into a perforated (dashed) cut pattern.

As described above, the sewing machine M of the second embodiment includes the first pitch setting unit which sets to the first pitch length the interval of cuts formed on the workpiece cloth CL by the up-down movement of the cutting needle 60, that is, the pitch length. The control unit controls the up-down drive mechanism 86 based on the detection results of the detection unit, so that cuts having the first pitch length set by the first pitch setting unit are formed on the workpiece cloth CL. The control unit further controls the rotational drive mechanism 87 so that the orientation of the blade 60*a* is changed according to the moving direction of the workpiece cloth CL.

According to the above-described configuration, when the user moves the workpiece cloth CL placed on the bed in any direction, the detection unit can detect a movement amount and a moving direction of the workpiece cloth CL. Consequently, the cutting needle 60 is rotated based on the results of detection by the detection unit so that the orientation of the blade 60*a* is changed according to the moving direction of the workpiece cloth CL. The cutting blade is moved up and down by the up-down drive mechanism 86 so that cuts are formed which have the first pitch length set on the basis of the results of detection by the detection unit. Thus, when the rotation and the up-down movement of the cutting needle 60 are repeated while the workpiece cloth CL is moved in any direction, a plurality of cuts having the first pitch length can be formed along the moving direction of the workpiece cloth CL. This can easily form a good-looking clear cut pattern composed of cuts oriented according to the moving direction of the workpiece cloth CL and having a uniform pitch length.

Further, in the second embodiment, the movement distance r and the moving direction θ of the workpiece cloth CL are detected every reciprocation of the cutting needle 60, so that the orientation of the blade 60*a* is accorded with the moving direction θ and set to a constant pitch length, with the result that a further clearer cut pattern can be formed.

Figure 16:
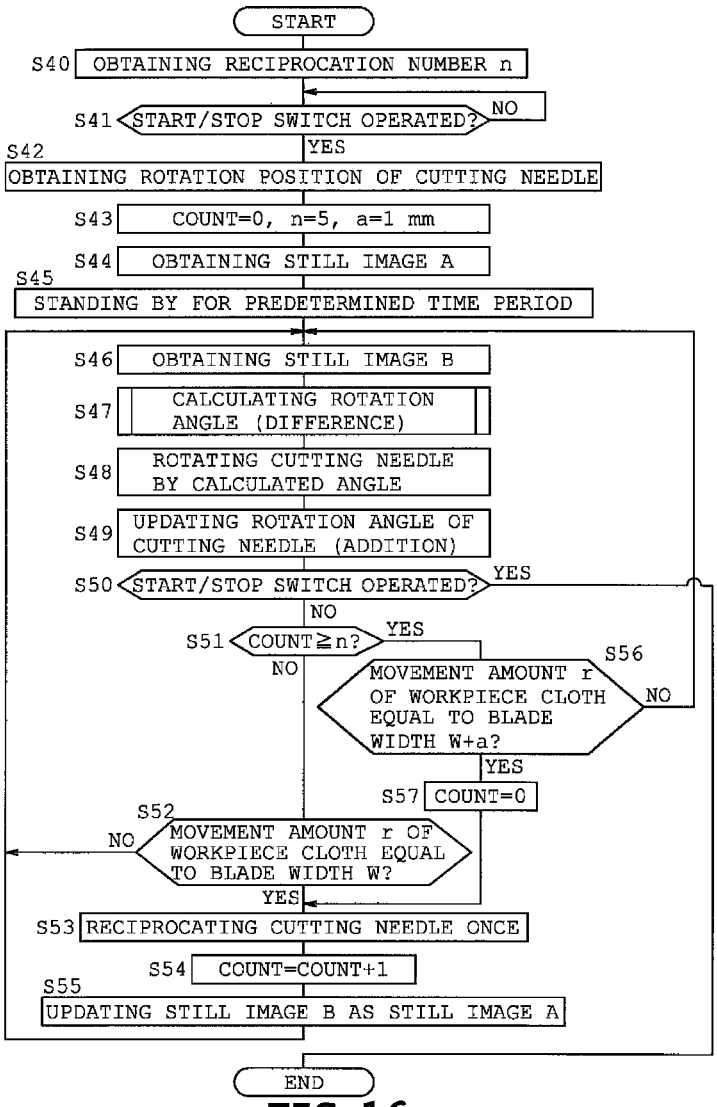
FIG. 16 is a view similar to FIG. 13, showing a third embodiment.
Figure 17C:
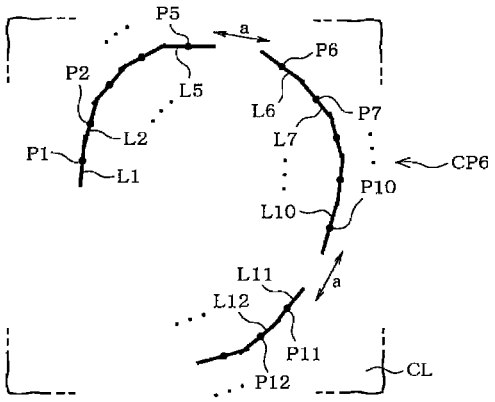

FIG. 16 illustrates a third embodiment. Only the differences between the second and third embodiments will be described. Identical or similar parts in the third embodiment will be labeled by the same reference symbols as those in the second embodiment. In the third embodiment, a cut pattern CP6 can be formed as exemplified in FIG. 17C. The cut pattern CP6 is a combination of the cut pattern CP4 and the cut pattern CP5. The cutting control program employed in the third embodiment includes a default a on the pitch length. The default a is a set value usable to set the pitch length to a predetermined second pitch length (1 mm, for example). The default a corresponds to a length of discontinuities (a part between cuts L5 and L6 and a part between cuts L10 and L11) of cuts L1, L2, . . . in the cut pattern CP6, as exaggeratingly shown in FIG. 17C. Thus, the pitch lengths between the cuts L5 and L6 and cuts L10 and L11 of a plurality of cuts L1, l2, . . . composing the cut pattern CP6 are set to a second pitch length obtained by adding the default a to the width W of the blade 60*a*.

Further, in the third embodiment, a number setting screen (not shown) is displayed on the display 9 in starting the free motion cut. The number setting screen is provided for setting the number of reciprocation of the cutting needle 60 to a predetermined number of times. More specifically, the user sets the number of reciprocation of the cutting needle 60 by the touch operation onto the touch panel 9*a* in order to optionally set a cut position of the second pitch length (discontinuities of cuts in the cut pattern). In this case, a setting screen (not shown) to set the second pitch length may be displayed on the display 9, so that the second pitch length may be set to any value by the touch operation on the touch panel 9*a*. The control device 39, the touch panel 9*a*, the display 9 and the like constitute a second pitch setting unit which sets the pitch length to the second pitch length and a number setting unit which sets the number of reciprocation of the cutting needle 60 to the predetermined number of times.

Referring to FIG. 16, the processing flow of the cutting control program in the third embodiment is shown. Substantially the same processing as steps S21 to S32 in the second embodiment is carried out at all the steps except steps S30, S43, S51, S54, S56 and S57. More specifically, the control device 39 causes the display 9 to display the number setting screen and obtains the reciprocation number n supplied by touch operation (step S40). When the start/stop switch 8*a* has been operated (YES at step S41), the control device 39 detects a rotation angle of the cutting needle 60 (step S42). The control device 39 resets a counter counting the number of reciprocation of the cutting needle 60 to 0 thereby to initialize the counter. The control device 39 further loads the supplied reciprocation number (five times, for example) and the default a to store them in the RAM 103 (step S43).

The control device 39 further obtains the still images A and B of the workpiece cloth CL (steps S44 to S46), specifies the moving direction of the workpiece cloth CL based on the still images A and B and performs processing to obtain the rotation angle of the cutting needle 60 (step S47). In this case, the control device 39 calculates a movement amount of the workpiece cloth CL as the movement distance r based on the still images A and B. The control device 39 further calculates the difference Ψ between the movement direction θ1 obtained from the equation (1) and the rotation angle θ0 of the cutting needle 60 obtained at step S42. As a result, the control device 39 drives the rotational drive mechanism 87 to rotate the cutting needle 60 with the difference Ψ serving as a rotation angle (step S48). The control device 39 then updates the rotation angle θ0 to θ1 (step S49).

The control device 39 reciprocates the cutting needle 60 once when the start/stop switch 8*a* has not been operated (NO at step S50) and the count value is less than the reciprocation number n (NO at step S51) and the movement amount of the workpiece cloth CL has reached the width W of the blade 60*a*. More specifically, when the current count value is 0 (NO at step S51), the control device 39 determines whether or not the movement distance r equals the width W of the blade 60*a* (step S52). When determining that the movement distance r equals the width W of the blade 60*a* (YES), the control device 39 drives the up-down drive mechanism 86 to reciprocate the cutting needle 60 once (step S53). Subsequently, the control device 39 increments the counter (step S54) and stores (updates) the still image B in the RAM 103 as the still image A (step S55), returning to step S46.

Thus, when the repeated steps S46 to S55 produce five cuts L1 to L5, the control device 39 determines at step S51 that the count value of the counter is equal to or larger than the reciprocation number n (=5) (YES). In this case, the control device 39 determines whether or not the movement distance r of the workpiece cloth CL is equal to the addition of the width W of the blade 60*a* and the default a (that is, the second pitch length) (step S56). When determining that the movement distance r of the workpiece cloth CL is less than the second pitch length (NO), the control device 39 repeats steps S46 to S51 and S56. As a result, the control device 39 sets the cutting needle 60 to a rotation angle according to the moving direction of the workpiece cloth CL based on the latest still image B.

When determining that the movement distance r of the workpiece cloth CL is equal to the second pitch length (YES at step S56), the control device 39 resets the counter to 0 (step S57). The control device 39 then drives the up-down drive mechanism 86 to reciprocate the cutting needle 60 once (step S53). The sixth cut L6 formed to have the second pitch length is further formed to be spaced from the cut L5 adjacent thereto (see FIG. 17C). The control device 39 thus counts as a counting unit the reciprocation number of the cutting needle 60 and sets the pitch length of the next cuts L6, L11, and . . . to the second pitch length every time the count reaches 5. As a result, discontinuities of the cuts are formed in the cut pattern CP6.

The reciprocation number n set on the number setting screen may optionally be set according to preference of the user. Further, the object placed on the bed 1 should not be limited to the workpiece cloth CL but may be a paper or resin sheet or the like. Accordingly, the reciprocation number n and the default a may be set to respective appropriate values according to a material of the object.

In the third embodiment, the second pitch setting unit sets the pitch length to the second pitch length that is longer than the width W of the blade 60*a*. When the reciprocation number of the cutting needle 60 counted by a count unit has reached the predetermined number set by the number setting unit, the control unit controls the up-down drive mechanism 86 so that the cuts are formed on the workpiece cloth W so as to have the second pitch length set by the second pitch setting unit. The control unit further resets the reciprocation number of the cutting needle 60 by the count unit. According to this configuration, the reciprocation number of the cutting needle 60 is set by the number setting unit, so that the discontinuities of the cuts can be formed in the cut pattern according to the set number.

Figure 18:
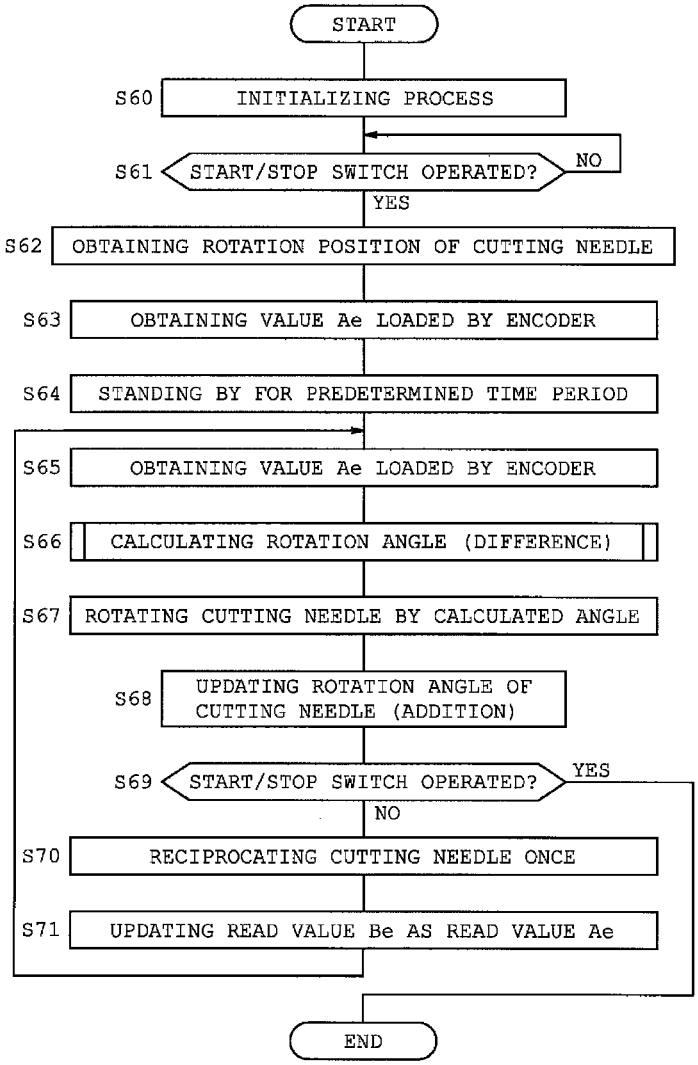
FIG. 18 is a view similar to FIG. 13, showing a fourth embodiment.

FIG. 18 illustrates a fourth embodiment. Only the differences between the first and fourth embodiments will be described. Identical or similar parts in the fourth embodiment will be labeled by the same reference symbols as those in the first embodiment. In the fourth embodiment, encoders 25 and 33 of the attachment 10 are used as the detection units which detect the movement amount and moving direction of the workpiece cloth CL. The moving table 11 is attached to the carriage 14 of the attachment 10 so that the workpiece cloth CL is placed on the moving table 11. When the free motion mode is selected by the touch operation onto the touch panel 9*a*, the cutting control is started in the free motion mode.

Referring to FIG. 18, the processing flow of the cutting control program in the fourth embodiment is shown. Firstly, at step S60 of initializing process, the control device 29 de-energizes the X-axis motor 22 and the Y-axis motor 29 when these motors are energized. As a result, the moving table 11 is freely movable in the X direction and the Y direction, that is, braking forces of both motors 22 and 29 are not applied to the moving table 11. The control device 39 further initializes count values (default=0) which will be described later. The control device 39 then receives detection signals from the X-axis encoder 25 and the Y-axis encoder 33 to start counting. In this case, the count value (X-phase count value) is incremented or decremented every time the control device 39 receives a detection signal from the X-axis encoder 25, and the count value (Y-phase count value) is incremented or decremented every time the control device 39 receives a detection signal form the Y-axis encoder 33. The control device 39 calculates a current position of the moving table 11 based on these count values.

When determining, in the above-described state, that the start/stop switch 8*a* has been operated by the user (YES at step S61), the control device 39 detects a rotation angle of the cutting needle 60 and stores the detected rotation angle in a rotation angle storage area of the RAM 103 (step S62). The control device 39 further reads the coordinate of the current position of the moving table 11 as a read-out value Ae and stores the read-out value in a first read-out value storage area of the RAM 103 (step S63). Subsequently, the control device 39 stands by for the predetermined time period (0.2 seconds, for example) and then reads a coordinate of current position of the moving table 11 as a read value Ae to store the read value Ae in the second read value storage area of the RAM 103 (steps S64 and S65). Based on the read values Ae and Be, the control device 39 specifies the moving direction of the workpiece cloth, obtaining the rotation angle of the cutting needle 60 (step S66).

More specifically, since the user manually moves the workpiece cloth CL in any direction together with the moving table 11 in the fourth embodiment, the X-direction and Y-direction movement amounts can be obtained from the read values of Ae and Be of the X-axis and Y-axis encoders 25 and 33. When the coordinate of the read value Ae is represented as (X1, Y1) and the coordinate of the read value Be is represented as (X2, Y2), the X-direction and Y-direction movement amounts ΔX and ΔY can be calculated by the following equations (3) and (4) respectively:

$$\Delta X = X2 - X1 \quad (3)$$

$$\Delta Y = Y2 - Y1 \quad (4)$$

The moving direction θ1 of the workpiece cloth CL is obtained when the movement amounts ΔX and ΔY are substituted in the equation (1). The control device 39 then calculates the difference Ψ (=θ1−θ0) between θ1 obtained from equation (1) and the rotation angle θ0 of the cutting needle 60 obtained at step S62. The control device 39 further drives the rotational drive mechanism 87 to rotate the cutting needle 60 with the obtained difference Ψ serving as the rotation angle (step S67). The control device 39 still further updates the rotation angle θ0 in the rotation angle storage area of the RAM 103 to θ1 (step S68).

When determining that the start/stop switch 8*a* has not been operated by the user (NO at step S69), the control device 39 drives the up-down drive mechanism 86 to reciprocate the cutting needle 60 once (step S70). In this case, the cut L1 is formed at an angle θ1 according to the moving direction of the workpiece cloth CL in the same manner as in the first embodiment. Subsequently, the control device 39 stores the read value Be in the first read value storage area of the RAM 103 as the read value Ae (step S71), returning to step S65. Thus, steps S65 to S61 are repeated so that the cut patterns CP1 to CP3 according to the movement amount of the moving table 11 can be formed on the workpiece cloth CL (see FIGS. 14A to 14C).

The sewing machine M of the fourth embodiment as described above uses the encoders 25 and 33 as the detection unit to detect the movement amounts ΔX and ΔY and the moving direction θ in the case where the workpiece cloth CL placed on the moving table 11 on the bed is moved together with the moving table 11. According to this configuration, the fourth embodiment can achieve the same advantageous effect as the first embodiment, for example, a plurality of cuts can be formed along the moving direction of the workpiece cloth CL.

The foregoing embodiments should not be restrictive but may be modified or expanded as follows. The sewing machine M may be configured to be capable of selectively performing the processing contents of the flowcharts in the first to fourth embodiments.

In each of the second and third embodiments, the encoders 25 and 33 may be used as the detection units which detect the movement amount and moving direction of the workpiece cloth CL. More specifically, in the second embodiment, too, step S60 is carried out as the initialization process and steps S63, S65, S66 and S71 are carried out instead of steps S23, S25, S26 and S32 in FIG. 15. This can move the workpiece cloth CL together with the moving table 11 with the moving table 11 being attached to the carriage 14 and further form a cut pattern having cuts oriented in the moving direction and having an equal pitch length.

In the third embodiment, step S60 may be carried out as the initializing process, and steps S63, S65, S66 and S71 may be carried out instead of steps S44, S46, S47 and S55 in FIG. 16. As a result, the work piece CL can be moved together with the moving table 11 with the moving table 11 being attached to the carriage 14, and various types of perforations can be formed on the workpiece cloth.

The detection unit should not be limited to the camera 38 and the encoders 25 and 33 but may be at least capable of detecting the moving direction of the object such as the workpiece cloth CL placed on the bed. For example, an imaging device (imaging unit) of the type that is used in an optical mouse provided with a digital signal processor (DSP) may be provided on the attachment 10. As a result, the movement amount and the moving direction of the object may be detected with images obtained by the imaging device serving as still images A and B. Further, an oscillator may be provided on the movable side moving table 11, for example. A receiver may be provided on the fixed side attachment 10. Ultrasonic waves oscillated from the oscillator may be received by the receiver, whereby the movement amount and moving direction of the moving table 11 (the object to be processed) may be detected.

The cutting unit 40 should not be limited to the application to the sewing machine M but may be applied to various types of sewing machines. Further, the cutting unit 40 should not be limited to provision on the bed but may be provided in the sewing machine head 3*a*. An auxiliary table can be attached to the bed 1, instead of the attachment 10. The auxiliary table is a known attachment for enlarging a surface on which the object is placed. When the auxiliary table is attached to the bed 1, an upper surface of the auxiliary table is substantially coplanar with the upper surface of the bed 1, thereby serving as the surface on which the workpiece cloth CL is placed. The auxiliary table may be provided with a housing part which detachably houses the cutting unit 40. The housing part may have the same configuration as the compartment 41 of the attachment 10. Alternatively, the up-down drive mechanism 86 and the rotational drive mechanism 87 may directly be assembled to the machine frame in the auxiliary table. In this construction, too, the cutting needle 60 can be in an upward direction such that the cutting needle 60 forms a cut in the object with upward movement from below, with the result that the same advantageous effects as the foregoing embodiments can be achieved.

The first pitch length, the second pitch length, the width W of the blade 60*a*, the default a and the line should not be limited to respective exemplified values but may appropriately be changed.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

We claim:

1. A sewing machine comprising:

a detection unit configured to detect a moving direction of an object to be processed when the object placed on a sewing machine bed is moved in any direction;

a cutting needle having a distal end formed with a blade edge and configured to form a cut in the object;

an up-down drive mechanism configured to reciprocate the cutting needle in an up-down direction;

a rotational drive mechanism configured to rotate the cutting needle about a rotation axis line of the cutting needle; and a control device configured to control the up-down drive mechanism and the rotational drive mechanism based on a result of detection by the detection unit so that an orientation of the blade edge is changed according to the moving direction of the object and the cutting needle is reciprocated to form the cut in the object with the blade edge being in the changed orientation.

2. A sewing machine comprising:

a detection unit configured to detect a moving direction and a movement amount of an object to be processed when the object placed on a sewing machine bed is moved in any direction;

a cutting needle having a distal end formed with a blade edge and configured to form a cut in the object;

an up-down drive mechanism configured to reciprocate the cutting needle in an up-down direction;

a rotational drive mechanism configured to rotate the cutting needle about a rotation axis line of the cutting needle;

a first pitch setting unit configured to set a pitch length to a first pitch length, said pitch length being an interval between cuts formed in the object by an up-down movement of the cutting needle; and a control device configured to control the up-down drive mechanism and the rotational drive mechanism based on a result of detection by the detection unit so that an orientation of the blade edge is changed according to the moving direction of the object and the cutting needle is reciprocated to form the cut in the object at the first pitch length with the blade edge being in the changed orientation.

3. The sewing machine according to claim 1, wherein the detection unit includes an imaging unit configured to image the object placed on the bed, and the imaging unit is configured to image the object every time of the reciprocation of the cutting needle to detect the moving direction of the object every time of reciprocation of the cutting needle, based on two images obtained before and after one reciprocation of the cutting needle respectively.

4. The sewing machine according to claim 2, wherein the detection unit includes an imaging unit configured to image the object placed on the bed, and the imaging unit is configured to image the object every time of the reciprocation of the cutting needle to detect the moving direction and the movement amount of the object every time of reciprocation of the cutting needle, based on two images obtained before and after one reciprocation of the cutting needle respectively.

5. The sewing machine according to claim 2, further comprising:

a second pitch setting unit configured to set the pitch length to a second pitch length that is longer than a width of the blade edge;

a count unit configured to a reciprocation number of the cutting needle; and a number setting unit configured to set the reciprocation number to a predetermined number, wherein when the reciprocation number of the cutting needle counted by the count unit reaches the predetermined number set by the number setting unit, the control device controls the up-down drive mechanism so that the cut is formed in the object with the pitch length changed from the first pitch length to the second pitch length and further controls the count unit so that the reciprocation number is reset.

6. The sewing machine according to claim 4, further comprising:

a second pitch setting unit configured to set the pitch length to a second pitch length that is longer than a width of the blade edge;

a count unit configured to a reciprocation number of the cutting needle; and a number setting unit configured to set the reciprocation number to a predetermined number, wherein when the reciprocation number of the cutting needle counted by the count unit reaches the predetermined number set by the number setting unit, the control device controls the up-down drive mechanism so that the cut is formed in the object with the pitch length changed from the first pitch length to the second pitch length and further controls the count unit so that the reciprocation number is reset.

7. The sewing machine according to claim 1, wherein the cutting needle, the up-down drive mechanism and the rotational drive mechanism are configured into a unit, and the unit is provided on an attachment which is detachably attached to the sewing machine.

8. The sewing machine according to claim 2, wherein the cutting needle, the up-down drive mechanism and the rotational drive mechanism are configured into a unit, and the unit is provided on an attachment which is detachably attached to the sewing machine.

* * * * *